US006131676A

United States Patent [19]

Friant et al.

[11] Patent Number: 6,131,676

[45] Date of Patent: Oct. 17, 2000

[54] SMALL DISC CUTTER, AND DRILL BITS, CUTTERHEADS, AND TUNNEL BORING MACHINES EMPLOYING SUCH ROLLING DISC CUTTERS

[75] Inventors: James E. Friant, Seattle; Michael A. Anderson, Auburn, both of Wash.

[73] Assignee: Excavation Engineering Associates, Inc., Seattle, Wash.

[21] Appl. No.: 09/167,041

[22] Filed: Oct. 5, 1998

Related U.S. Application Data

[60] Provisional application No. 60/072,883, Jan. 20, 1998, and provisional application No. 60/061,191, Oct. 6, 1997.

[51] Int. Cl.[7] ..... E21B 10/22

[52] U.S. Cl. ..... 175/371; 175/373; 175/367

[58] Field of Search ..... 175/373, 337, 175/348, 371, 412, 413, 351, 364, 367, 368, 369

[56] References Cited

U.S. PATENT DOCUMENTS

| | | | |
|---|---|---|---|
| Re. 17,700 | 6/1930 | Crickmer et al. . | |
| Re. 17,856 | 11/1930 | Bell . | |
| Re. 19,339 | 10/1934 | Vertson . | |
| Re. 32,495 | 9/1987 | Coates | 175/339 |
| D. 372,253 | 7/1996 | Huffstutler et al. | D15/139 |
| 892,180 | 6/1908 | Patten et al. . | |
| 1,090,952 | 3/1914 | Vandergriff . | |
| 1,209,299 | 12/1916 | Hughes . | |
| 1,468,509 | 9/1923 | Overman . | |
| 1,488,833 | 4/1924 | Reed . | |

(List continued on next page.)

FOREIGN PATENT DOCUMENTS

| | | |
|---|---|---|
| 965807 | 4/1975 | Canada . |
| 1087640 | 10/1980 | Canada . |
| 936382 | 12/1955 | Germany . |
| 24 49 405 | 4/1976 | Germany . |
| 533719 | 10/1976 | Russian Federation . |
| 732483 | 5/1980 | Russian Federation . |
| 1305295 | 4/1987 | Russian Federation . |
| 146157 | 3/1989 | Russian Federation . |

OTHER PUBLICATIONS

Security/Dresser, "Dresser Oilfield Catalog", Rock Bits, Diamond Products, Drilling Tools, Security Means Technology, (40 pages) (Not Dated).

"State of the Science in Rock Bit Technology" by Carlos Fernandez, SPACEBIT, (25 pages) (Not Dated).

*Primary Examiner*—David Bagnell
*Assistant Examiner*—Zakiya Walker
*Attorney, Agent, or Firm*—R. Reams Goodloe, Jr.

[57] ABSTRACT

Small diameter rotary drill bits using rolling disc cutters. Novel small diameter rotary drill bits with detachable pedestal mounted rolling disc cutters are provided. The bit body has a plurality of longitudinal edge mounting slots located at preselected angularly spaced apart locations. Preferably, the slots each have an upper protective ledge and downwardly extending sidewalls. A set of peripheral pedestal mounts each having a mounting portion sized and shaped to fit into a preselected mounting slot are provided and each is detachably mounted in its preselected mounting slot. In one embodiment, the longitudinally extending slots further comprise a wedge shaped edge portion, and the pedestal mounts have a complimentary angularly shaped portion, so that when the pedestal mount is brought into a close fitting relationship with the longitudinal slot, the pedestal mount and the longitudinal slot are tightly and securely interfitting. The pedestal mounts each include, at the lower reaches thereof, at least one small diameter single cutting edge rolling disc cutter. The rolling disc cutters are affixed at individually preselected radially spaced apart locations with respect to a central longitudinal axis forming the center of rotation of the rotary drill bit. Also, each of the rolling disc cutters is mounted at a preselected angle delta with respect to the central longitudinal axis forming the center of rotation of the rotary drill bit. Also, the rolling disc cutters are preferably detachably affixed to the pedestal mounts.

49 Claims, 15 Drawing Sheets

U.S. PATENT DOCUMENTS

| | | | |
|---|---|---|---|
| 1,533,286 | 1/1925 | Wickersham . | |
| 1,552,724 | 9/1925 | Moore . | |
| 1,604,388 | 10/1926 | Calvin . | |
| 1,636,664 | 7/1927 | Reed . | |
| 1,646,620 | 10/1927 | Loy . | |
| 1,657,605 | 1/1928 | Bell . | |
| 1,657,608 | 1/1928 | Crickmer . | |
| 1,657,610 | 1/1928 | Crickmer et al. . | |
| 1,670,092 | 5/1928 | Bailey . | |
| 1,764,432 | 6/1930 | Bronson . | |
| 1,843,096 | 1/1932 | Kubin et al. . | |
| 1,846,212 | 2/1932 | Kubin et al. . | |
| 1,852,843 | 4/1932 | Greve . | |
| 1,906,427 | 5/1933 | Sievers et al. . | |
| 1,908,049 | 5/1933 | Reed . | |
| 1,935,654 | 11/1933 | Millican . | |
| 2,003,791 | 6/1935 | Sperry . | |
| 2,030,723 | 2/1936 | Scott et al. . | |
| 2,047,112 | 7/1936 | Reed . | |
| 2,063,012 | 12/1936 | Catland . | |
| 2,064,273 | 12/1936 | Scott . | |
| 2,065,743 | 12/1936 | Reed . | |
| 2,068,375 | 1/1937 | Catland . | |
| 2,086,486 | 7/1937 | Woods . | |
| 2,124,521 | 7/1938 | Williams et al. . | |
| 2,151,347 | 3/1939 | Fisher . | |
| 2,174,102 | 9/1939 | Catland . | |
| 2,176,358 | 10/1939 | Pearce . | |
| 2,260,487 | 10/1941 | Scott . | |
| 2,318,370 | 5/1943 | Burch . | |
| 2,648,526 | 8/1953 | Lanchester . | |
| 2,704,204 | 3/1955 | Koontz . | |
| 2,782,005 | 2/1957 | Appleton . | |
| 2,807,444 | 9/1957 | Reifschneider . | |
| 2,886,293 | 5/1959 | Carr et al. . | |
| 2,893,696 | 7/1959 | McGuire . | |
| 2,950,090 | 8/1960 | Swart . | |
| 3,041,055 | 6/1962 | Risse | 262/26 |
| 3,130,801 | 4/1964 | Schumacher, Jr. | 175/374 |
| 3,216,513 | 11/1965 | Robbins et al. | 175/227 |
| 3,442,342 | 5/1969 | McElya et al. | 175/374 |
| 3,596,724 | 8/1971 | Bechem | 175/331 |
| 3,628,616 | 12/1971 | Neilson | 175/375 |
| 3,679,009 | 7/1972 | Goodfellow | 175/374 |
| 3,750,772 | 8/1973 | Venter | 175/364 |
| 3,752,243 | 8/1973 | Hummer et al. | 175/364 |
| 3,778,107 | 12/1973 | Haspert | 299/11 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte | 219/121 EM |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Vezirian | 308/8.2 |
| 4,187,743 | 2/1980 | Thomas . | |
| 4,209,124 | 6/1980 | Baur et al. | 228/182 |
| 4,234,235 | 11/1980 | Robbins et al. | 299/56 |
| 4,256,194 | 3/1981 | Varel | 175/375 |
| 4,258,807 | 3/1981 | Fischer et al. | 175/375 |
| 4,280,571 | 7/1981 | Fuller | 175/337 |
| 4,333,364 | 6/1982 | Varel . | |
| 4,350,060 | 9/1982 | Vezirian . | |
| 4,352,400 | 10/1982 | Grappendorf et al. | 173/330 |
| 4,359,114 | 11/1982 | Miller et al. | 173/344 |
| 4,369,849 | 1/1983 | Parrish | 175/340 |
| 4,417,629 | 11/1983 | Wallace | 175/365 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,657,091 | 4/1987 | Higdon | 175/229 |
| 4,711,143 | 12/1987 | Loukanis et al. . | |
| 4,727,943 | 3/1988 | Wood | 175/229 |
| 4,750,573 | 6/1988 | Wynn | 175/337 |
| 4,765,205 | 8/1988 | Higdon . | |
| 4,804,295 | 2/1989 | Kondo | 405/141 |
| 4,813,502 | 3/1989 | Dysart | 175/337 |
| 4,817,852 | 4/1989 | Hill | 228/114 |
| 4,832,136 | 5/1989 | Mattsson et al. | 175/57 |
| 4,848,497 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett et al. | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,234,064 | 8/1993 | Lenaburg | 175/373 |
| 5,281,260 | 1/1994 | Kumar et al. | 75/240 |
| 5,289,889 | 3/1994 | Gearhart et al. | 175/325.5 |
| 5,325,932 | 7/1994 | Anderson et al. | 175/325.3 |
| 5,351,768 | 10/1994 | Scott et al. | 175/374 |
| 5,421,422 | 6/1995 | Crane et al. | 175/363 |
| 5,439,067 | 8/1995 | Huffstutler | 175/339 |
| 5,439,068 | 8/1995 | Huffstutler et al. | 175/356 |
| 5,547,033 | 8/1996 | Campos, Jr. | 175/331 |
| 5,553,681 | 9/1996 | Huffstutler et al. | 175/339 |
| 5,586,611 | 12/1996 | Dorosz | 175/369 |
| 5,626,201 | 5/1997 | Friant et al. | 175/365 |
| 5,641,029 | 6/1997 | Beaton et al. | 175/356 |
| 5,904,211 | 5/1999 | Friant et al. | 175/228 |

BIT PROFILE 17 1/2 Inch Bit Test Setup Schematic

SMALL DISC CUTTER, AND DRILL BITS, CUTTERHEADS, AND TUNNEL BORING MACHINES EMPLOYING SUCH ROLLING DISC CUTTERS

"This application is a continuation of copending U.S. Provisional Application No.: 60/072,883 filed on Jan. 20, 1998 which claims the benefit of U.S. Provisional Application No.: 60/061,191 filed on Oct. 6, 1997."

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

This invention uses rolling disc cutter technology for small drill bit applications, for cutter head applications, and for tunnel boring machine applications, the fundamentals of which were set forth in detail in prior application Ser. No. 08/125,011, filed Sep. 09, 1993, now U.S. Pat. No. 5,626,201, issued May 06, 1997, the disclosure of which is incorporated herein by this reference.

TECHNICAL FIELD

This invention relates to improved drill bits for cutting rock, and more particularly, to the use of small diameter rolling type disc cutters in various rock cutting applications.

BACKGROUND

Anyone familiar with the drilling arts is well acquainted with the "tri-cone" drill bit. The "tri-cone" bits are so named because the cutting elements consist of three cones, studded about their conical surface with teeth, or for harder rock, with tungsten carbide buttons. The genesis of such bits was the dual cone bit developed by Howard Hughes, Sr., and introduced in 1909. That dual cone type bit had sharp concentric rings about the cone. Later, in the 1930's, a third cone was added, and the design became a "tri-cone". When sintered tungsten carbide became available, such cones were fitted with protruding carbide buttons in a variety of shapes and patterns. Such conical cutters are sometimes referred to as "raspberry cutters" because their appearance is vaguely suggestive of raspberries. Over the years, various improvements have been made in bearings, seals, lubricants, and in the tungsten carbide alloys and shapes. Still, however, the basic "tri-cone" bit is the primary bit design used in drill bits for drilling through hard rock today.

In the early 1950's, tunnel boring machines ("TBMs") attempted to attack harder rock formations. To do so, many TBMs were equipped with multi-row rings of steel tooth or carbide button cutters; such cutters were initially based on drill bit cutting tool experience. However, in 1956, on a sewer drilling project in Toronto, Canada, a TBM unit was equipped with single disc cutters, and in using such cutters, set an impressive record of one hundred five (105) feet [32 meters] distance bored through rock in one day. Resultingly, by 1979, the remaining TBM manufacturers equipped their machines with single rolling disc cutters.

A similar situation occurred in large diameter rotary drilling, such as is used for excavating a mine shaft. In 1979, a ninety nine (99) inch [251.5 cm] drill head equipped with all rolling disc cutters was successfully demonstrated, and it set advance rate records in hard limestone. As in the tunnel boring industry, that technology is now employed by virtually all commercial big hole drilling operators.

The fundamental rationale for the productivity of the single cutting edge rolling disc cutter technology can be understood by reference to FIG. 1. The graph provided in FIG. 1 shows the relationship between energy required for drilling as a function of the mean particle size of the chip or cuttings created by the excavation tool. Significantly, when the average chip size is large, the energy required to excavate a give amount of rock is small. Conversely, if the tool grinds the rock into very small particles of sand or powder, the specific energy of excavation is high. Another way to look at the situation is that if the cutting machinery consumes considerable power grinding the rock to powder, the rate of advance will be slow. Fundamentally, to improve the rate of advance without increasing the power requirements, larger size cuttings must be created.

In an instrumented test, we have found that a typical "off-the-shelf" tri-cone bit of nine and one-quarter inch (9¼") [23.5 cm] size required a specific energy of eighty (80) horsepower-hour per ton (hp-hr/ton) in well cured concrete. For drilling in basalt, the same tri-cone bit consumed a specific energy of one hundred twenty (120) hp hr/ton. Such bits expend a considerable portion of their power input in the crushing and grinding of the rock being excavated. Since larger diameter cutterheads equipped with rolling disc cutters presently routinely achieve three (3) to seven (7) hp-hr/ton, it can be appreciated that it would be desirable to improve the specific energy of excavation in small diameter rotary drill bits.

Several attempts have been made which to some limited extent tried to provide the desired results, and some of such apparatus superficially resembles the present invention to some small degree. First, early in the history of the Hughes Tool Company, a bit containing two thin disc cutters mounted on a bit body was built and tested. The discs were mounted one on each side of the bit, and gouged the ground in a rolling, scraping motion. However, the discs did not engage the ground in multiple concentric kerfs to form chip type cuttings, but excavated rock by a scouring action. That technique is feasible only for soft materials, and would not long work in rock. Thus, it was never commercialized, evidently because other designs are more satisfactory, even in soft ground. Second, there are some drill bit designs, formerly quite common but now largely phased out of use, which utilize cones with multiple sharpened edges. Those designs have been referred to by some as "disc cutters", and produce concentric circles in the rock face, and do excavate with a chipping action. See the prior art bit cone 25 shown in FIG. 2, for an example. On small diameter cutters, three such multi-row cutters were used, thus conforming to the tri-cone bit arrangement. That design was tried in attempts to form multiple tracks or kerfs in the rock face. However, the design became largely obsolete because it is relatively poor performing compared to the best button type cutters. Now, our novel rolling disc cutter design provides such an improvement over prior art cutters as to make such multi-row cutters totally obsolete.

BRIEF DESCRIPTION OF THE DRAWING

For a better understanding of the nature, objects and advantages of our invention, the general principles of its operation, and of the prior art pertaining thereto, reference should be made to the following detailed description, taken in conjunction with the accompanying drawing, in which.

In order to minimize repetitive description, throughout the various figures like parts are given like reference numerals.

SUMMARY

Figure 1:
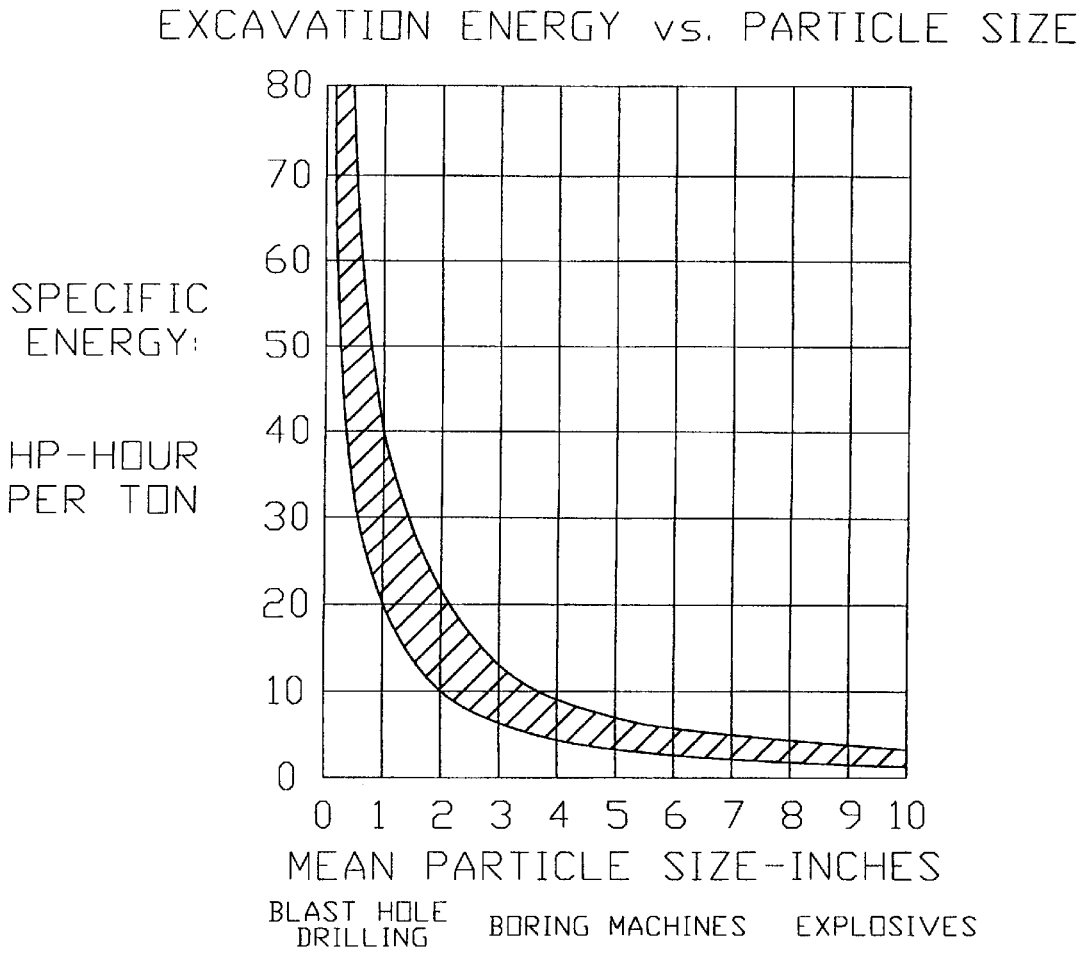
FIG. 1 is generalized graphic illustration of the relationship between specific energy required for excavation and the mean particle size produced by the excavation apparatus.
Figure 2:
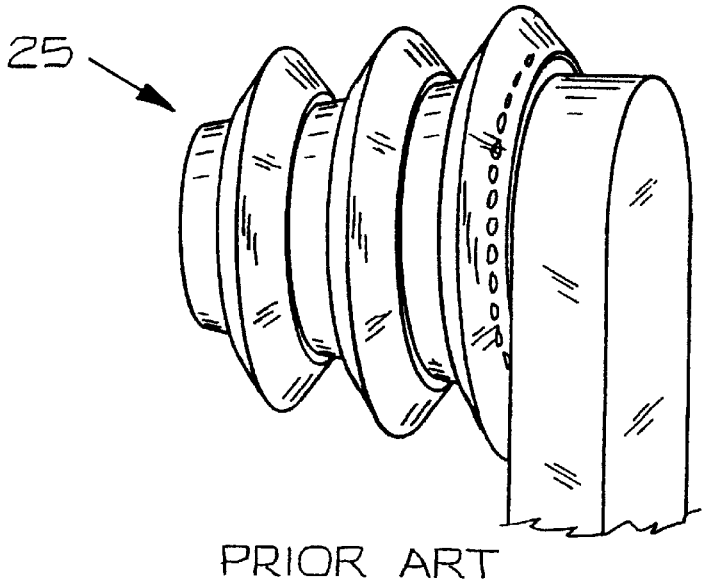
PRIOR ART FIG. 2
FIG. 2 shows a prior art multi-edge cone-shaped rolling cutter as used in some types of tri-cone bits.

The present invention is directed to novel drill bit designs, and to methods of employing the same in hard rock drilling, which dramatically improves production rates for producing boreholes, especially in the small size range common in oil, gas, and geothermal applications. More particularly, our novel drill bit is designed for improved drilling performance in standard size drill bit applications, in particular such as bits of about 7.875 inches [20 cm], of about 13 ¼ inches [33.65 cm], or of up to about 17.5 inches [44.45 cm] diameter or so, or more broadly, anywhere from about 6.75 inch [17.15 cm] diameter up to about 24 inch [60.96 cm] diameter, or larger. Our invention relates to a novel small diameter drill bit design which provides:

improved drill bit geometries;

high footprint pressure, for improved drilling rates;

improved disc cutter bearing designs;

more robust structural supports for the disc cutter;

simplified cutter mounting apparatus and methods; and improved cutter rebuilding methods.

In addition, the drill bit using rolling disc cutters of the present invention provides higher penetration into a given rock at lower thrust than conventional drilling bits. cutters. This performance factor at lower thrust is very significant. The lower thrust requirements possible by use of our designs allow lower operating power requirements for a given drilling task, or, more advantageously, a higher drilling rate at comparable thrust.

We have developed a novel drill bit using single disc type rolling disc cutters for use in a drilling apparatus to exert pressure against substantially solid matter such as rock by acting on the rock face. The single disc type rolling cutters are of the type which upon rolling forms a kerf by penetration into the face so that, by using two or more such single disc rolling cutters, solid matter between a proximate pair of said kerfs is fractured to produce chips which separate from the face. The drill bit components include a bit body designed for rotation about an axis of rotation when driven by a drill string which is normally attached to the bit body by conventional standard threaded connections. The bit body preferably includes at least one longitudinally extending fluid passageway, in fluid communication with a similar passageway in the drill string, for containing a fluid such as water, air, or drilling mud, to allow such fluid to be supplied to the drilling surface, or to allow cuttings to be removed from the drilling surface by carriage in such fluid. Around the periphery of the drill bit, a plurality of downwardly extending attachment slots are provided to accommodate, preferably in detachable fashion, complementary, robust pedestals on each of which a single edge rolling disc cutter is rotatably affixed. The pedestals are spaced apart, circumferentially, so as to allow a large cross-sectional area between adjacent pedestals and laterally between the bit body and the borehole being drilled, so as to enable easy, low pressure drop fluid passage between the drill bit and the borehole. Also, the lower surface of the drill bit may accommodate attachment, preferably by weldment, of a downwardly extending pedestal on which a single edge rolling disc cutter is rotatably affixed.

The rolling disc cutters are the cutting edge of a cutter ring assembly. The cutter ring assembly includes the annular ring which forms the cutting edge. That annular ring has an interior annulus defining portion and an outer cutting edge ring portion. The outer cutting edge ring portion includes a cutting edge having diameter OD and radius $R_1$. The cutter ring assembly further includes a bearing assembly, which is shaped and sized to substantially fit into the annulus defined by the cutter ring and in a close fitting relationship with a relatively stiff shaft, so that the cutter ring may rotate with respect to, and be supported by the shaft, with minimal deflection of the shaft. The bearing assembly includes a bearing, and a seal assembly. The seal assembly is adapted to fit sealingly between the rotating outer ring portion and at least a portion of the shaft. The seal assembly provides a lubricant retaining and contamination excluding barrier between the cutter ring and the bearing. A retainer assembly, which includes a retainer plate and fasteners to affix the retainer plate to the shaft, is provided to retain the cutter ring assembly on to the shaft. A hub cap is sealingly affixed to the cutter ring, in order to seal the interior annular portion of the cutter ring assembly, so that, in cooperation with the seal assembly and the cutter ring, a lubricant retaining chamber is provided. Preferably, the lubricant retaining chamber is provided with a pressure compensation device to balance the external pressure with the lubricant pressure behind the seal assembly, to prevent inward pressure differentials (toward the lubricant reservoir) between the lubricant inside the cutter ring assembly bit and the fluids outside the cutter ring assembly.

OBJECTS, ADVANTAGES, AND NOVEL FEATURES

The present invention has as its objective the provision of a novel small diameter drill bit which dramatically improves cutting rates, and which accomplishes drilling at lower specific energy levels compared to presently used drill bits in small diameter applications such as those common in oil, gas, and geothermal industries.

Our single cutting edge rolling disc cutters are mounted so that they are true rolling at every position on the drill bit, unlike multi-blade or button cone bits which are true rolling in only one position, which undesirably results in skidding at some portion of such cone type bits.

Our single cutting edge rolling disc cutters are mounted so that they form an optimum profile to effect a desirable kerf spacing, unlike cone type cutters which are limited in placement because multiple cutting surfaces are mounted on a single shaft.

Our single cutting edge rolling disc cutters are capable of deep penetration, unlike multi-blade or button cones which are limited in the depth of cut by the valleys between the ridges or blades.

Our single cutting edge rolling disc cutters slice through any cuttings which are not quickly cleared, thus minimizing regrinding of such cuttings, unlike multi-blade and button cones which function like rolling pins, thus crushing and re-crushing all the cuttings.

Our single cutting edge rolling disc cutters do not ball up easily, unlike multi-blade or button cones which, due to their rolling pin action, tend to compact material between the ridges or blades.

Our single cutting edge rolling disc cutters penetrate further into the rock with a given force than cone type cutters, since unlike such prior art bits, the available force is not shared with multiple rows of blades, nor are there limiting solid valleys between between the ridges or the blades as in such prior art cutters.

Our single cutting edge rolling disc cutters can be easily replaced when worn out, unlike cone type cutters which are seldom rebuilt in the field because of the expense, and because most can only be removed destructively, only factory rebuilding of such prior art type cutters is commonly practiced.

It is therefore an important feature of this invention that the drill bit design provides a mechanical design which requires little or no operational or drilling equipment changes when our drill bits are substituted for conventional drill bits.

It is consequently an important advantage that our drill bits can be employed in standard sizes, with standard threads.

It is also an important advantage that our novel drill bits can run at similar rotary speed (rpm), thrust (weight on bit—"WOB"), and torque as conventional drill bits.

It is an important and primary object of our invention that our drill bit design requires less hydraulic power than conventional bits, and more particularly, that a single centrally located low pressure drop fluid nozzle can enable cutting rates equal to multiple high pressure drop fluid nozzles for sweep of cuttings from the face.

It also an important object of this invention to provide a simplified drill bit design which reduces the cost of operating and maintaining drill bits.

It is therefore a feature of our novel drill bits that the weight and complexity of the disc cutter is significantly reduced, and that the weight of replaceable parts are easily manageable by field workers.

It is accordingly an important feature of our invention that the pedestals, assembled with disc cutters, may be completely attached to or removed from the bit body in minutes with common hand tools by a single workman, without resort to heavy lifting equipment.

Another related and important feature of our drill bit design is that the disc cutters utilized can be non-destructively removed from the pedestals, so that new, replacement cutters may be installed on existing pedestals.

A further objective of this invention is to provide a robust pedestal mounting method which permits close kerf (concentric cutter tracks) spacing, in order to provide kerf spacing of less than one (1) inch.

It is a novel feature of this invention that the mating surfaces of the bit body and the pedestals are wedge shaped and that the pedestals are secured in the bit body by long bolts, preferably of the automatically spring tightening type, to provide a solid vibration resistant design.

It is an advantage that welding of a pedestal to the drill bit, though normally unnecessary, is easily accomplished for special purpose bits due to the unique location bit body and pedestal mating design configuration.

Yet another advantage of our drill bit design is that the pedestal mounting design, and the scalloped bit body, maximizes the cross-sectional area available for return of fluid up to the annulus surrounding the drill string.

A related objective is to achieve the ability to closely space disc cutters on the drill bit such that only one disc cutter is assigned to one track or kerf (single tracking) on drill bits in common sizes.

Another related objective is to provide a rolling disc cutter and drill bit design which permits identical and interchangeable rolling disc cutters to be deployed at every position on the drill bit.

Another object of this invention is to provide a rolling disc cutter sized so that a plurality of identical disc cutters can be placed on a drill bit body.

Yet another object of this invention is to provide rolling disc cutters in an optimum profile on a drill bit and located for best dynamic balance.

It is a feature of our invention that because of the small size of our rolling disc cutters, and because the cantilever construction of pedestals requires such a small mounting area, that the bit profile can be easily optimized.

A still further object of this invention is to provide a novel drill bit which makes it possible to reduce the size of a drill bit capable of utilizing rolling disc cutter technology.

Yet another object of this invention is to provide small rolling disc cutters capable of being mounted on a bit body for superior performance and superior wear rates, compared with conventional drill bit design.

It is a feature of this invention that our rolling disc cutter blades are true rolling in nature, and thus skidding encountered during operation is minimal.

It is still another feature of our drill bit design that small rolling disc cutters with a small footprint can be provided in a bit pattern configuration where cutters are uninhibited by adjacent cutter blades, thus allowing deep cuts by each cutter blade.

Other objects of the invention will be apparent hereinafter. The invention accordingly is broadly directed to the provision of a superior drill bit design which utilizes novel rolling type cutters, and to an improved drilling method incorporating the use of our improved drill bit design for maintaining high cutting efficiency while minimizing hydraulic requirements.

DESCRIPTION

The present invention will now be described by way of example, and not limitation, it being understood that a small diameter drill bit which utilizes long wearing single cutting edge rolling disc cutters may be provided in a variety of desirable configurations in accord with the exemplary teachings provided herein.

Basic Drill Bit Details

Figure 3:
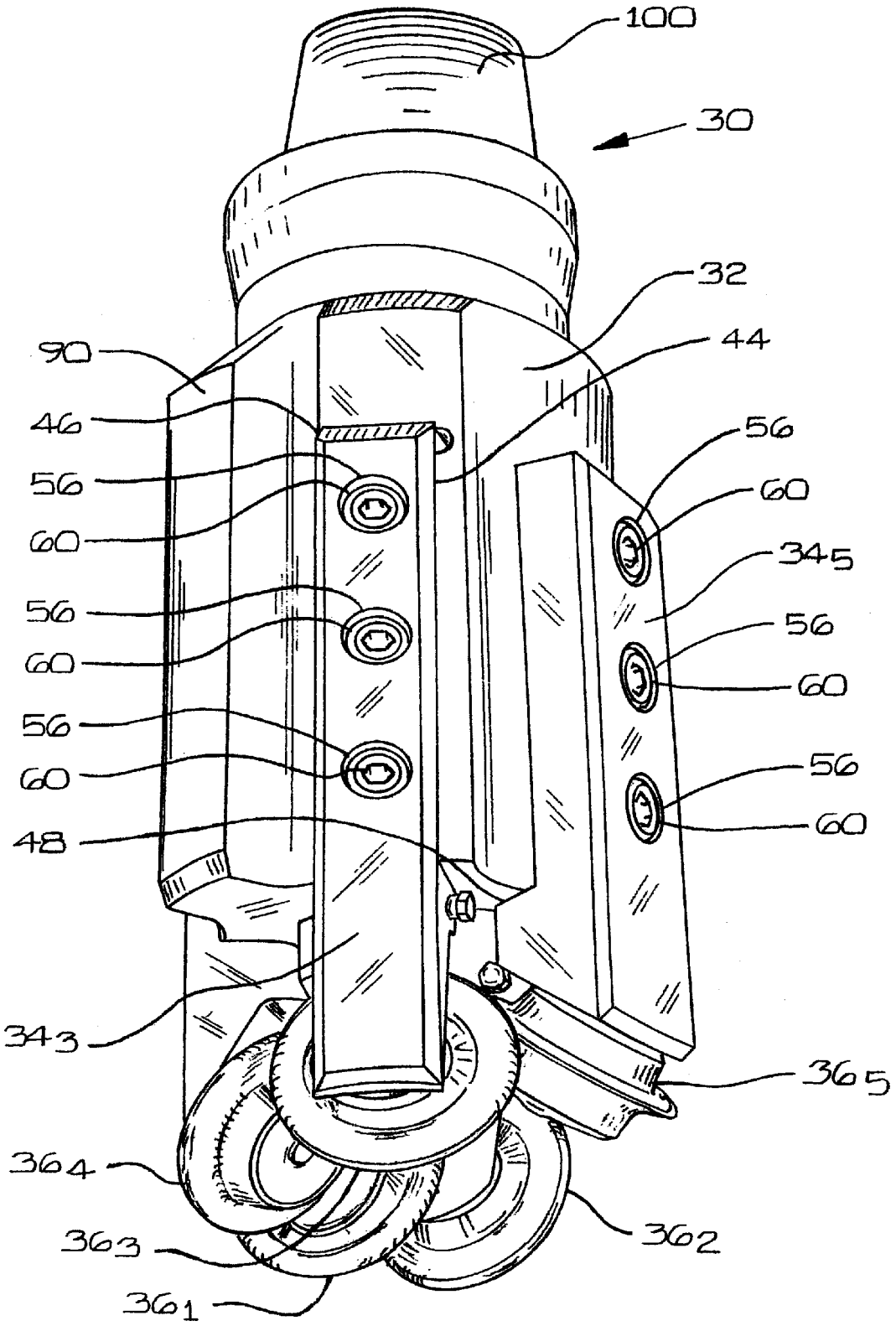
FIG. 3 is a perspective view of our novel drill bit, shown provided in a nominal 7.875 inch diameter bit size, utilizing five rolling Mini-Disc(tm) brand cutters provided by Excavation Engineering Associates, Inc. of Seattle, Wash., and having four of the rolling disc cutters detachably mounted via downwardly extending pedestals.
Figure 4:
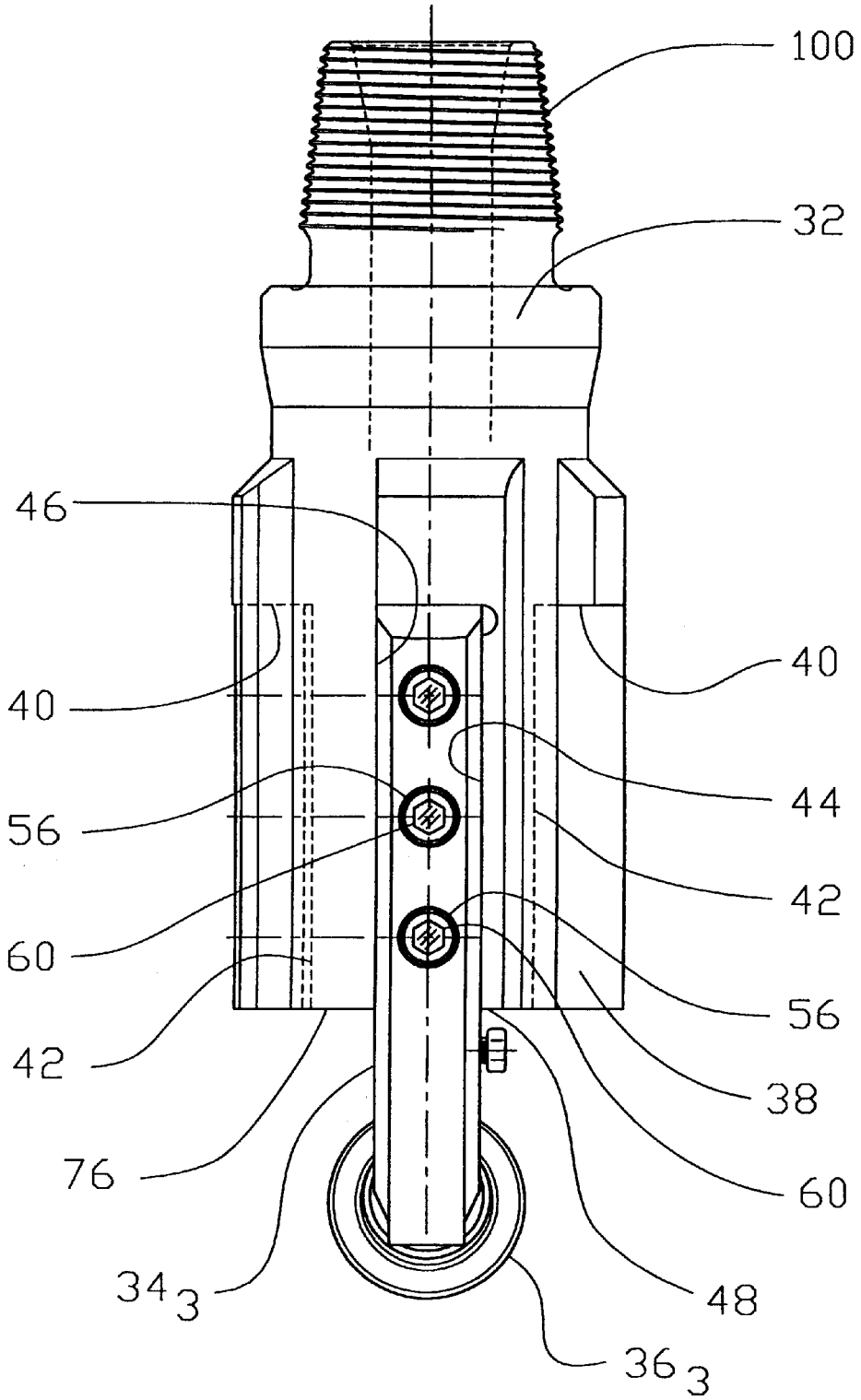
FIG. 4 is a partial side elevation view of a bit of the type just shown in FIG. 3, now illustrating the bit during assembly of a pedestal to the bit body, showing how the first detachable pedestal mount having thereon a rolling type Mini-Disc(tm) brand cutter is attached to the bit body, and also showing the recessed mounting grooves in the bit body which received the pedestal mounts.
Figure 6:
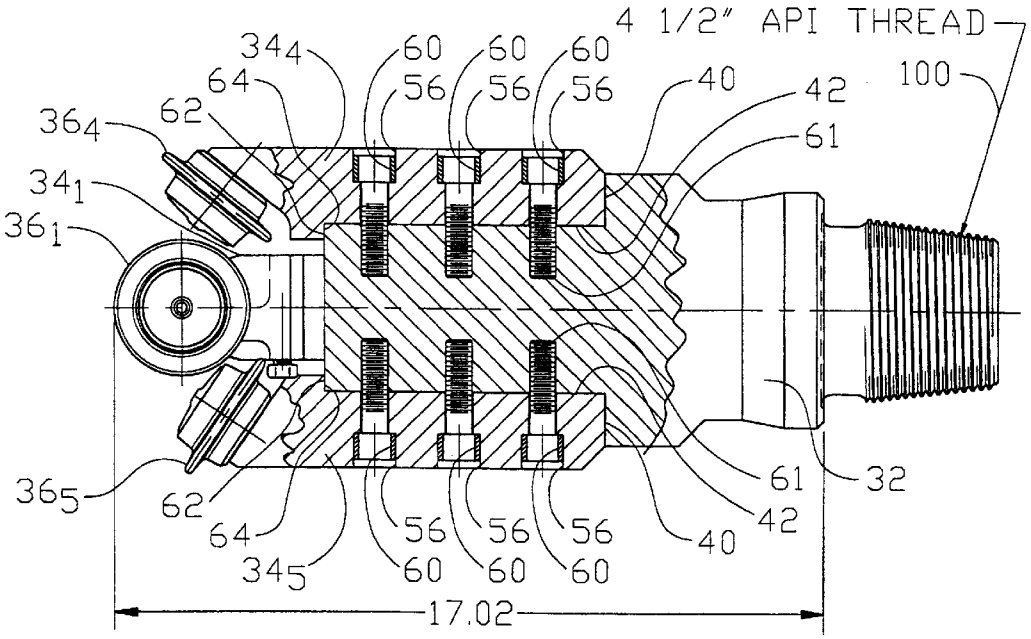
FIG. 6 is a partial cross-sectional view of the drill bit first shown in FIGS. 3, 4, and 5, with the cross-sectional portion of the view taken as if through the section line 6—6 of FIG. 5, illustrating the bit body and detachably affixable pedestal mounts with a rolling type Mini-Disc(tm) brand cutter attached.

Attention is now directed to FIG. 3, where one embodiment of our novel drill bit 30 is shown by way of a perspective view of an exemplary 7 ⅞ inch [20 cm] diameter bit, and to FIGS. 4, 5, 6, and 7, where other details of the same embodiment of our novel drill bit are illustrated. Our drill bit 30 is comprised of three major parts, namely the bit body 32, the pedestal mounts 34, and the rolling disc cutter assemblies 36, preferably provided one each per pedestal mount 34. The bit body 32 has formed therein longitudinally extending slots 38 (see FIG. 8), each of which starts at ledge 40, and are further defined by bottom 42 and first 44 and second 46 sidewalls, for accommodating pedestal mounts 34. The slots 38 terminate at a lower end 48. The structure of the slots 38 may be better appreciated by reference to FIG. 8, which shows a second embodiment, namely bit body 50 that is designed for use in a 17.5 inch [44.45 cm] drill bit 52 utilizing seven rolling disc cutter assemblies 36. Importantly, pedestal mounts 34 are provided with a sloping wedge shaped sidewall 54, which mates with second sidewall 46 of slots 38, to allow the pedestal mounts 34 to be securely wedged in bit body 32 (or bit body 50, for example). The peripherally located pedestal mounts 34, numbered $\mathbf{34}_1$, $\mathbf{34}_2$ through $^{34}$n, where "n" is a positive integer, are affixed in slots 38 are detachably secured to bit body 32 at apertures 56, via socket head type cap screws 60, such as nominal 0.635 inch 18 UNF screws of appropriate length for the service. These long bolts 60, preferably of the automatically spring tightening type, provide a solid vibration resistant design in a convenient threaded fastener configuration. Cap screws 60 are secured in place by threadably securing the same in threaded fastener receptacles 61 in the bit body 32 (or 52). For added security in mounting, each pedestal 341 through $\mathbf{34}_n$ preferably includes a lower inwardly extending lip portion 62 which sits over a lower retaining portion 64 of bit body 32. In this manner, forces acting against pedestals $\mathbf{34}_1$ through $^{34}$n are properly resisted during use of the drill bit 30. Also, as is shown in FIG. 3, each pedestal mount $\mathbf{34}_1$ through $\mathbf{34}_n$ have affixed to the lower reaches thereof a corresponding cutter assembly $\mathbf{36}_1$ through $\mathbf{36}_n$.

Figure 7:
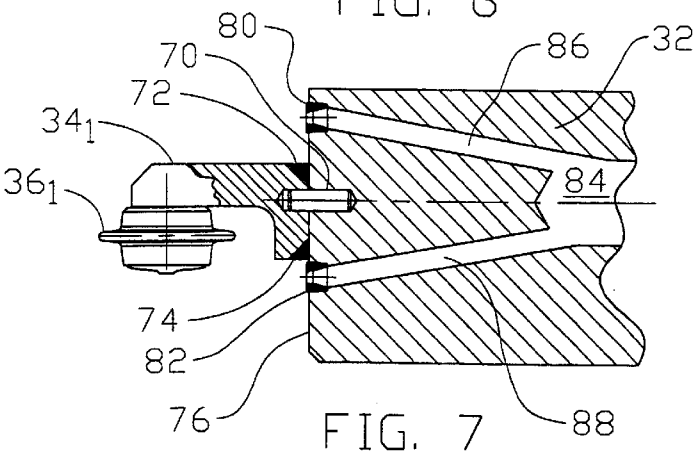
FIG. 7 is a partial cross-sectional view of a portion of the bit previously shown in FIGS. 3, 4, 5, and 6, now showing the attachment of a centrally located disc cutter by welding of the pedestal to the drill bit body.
Figure 8:
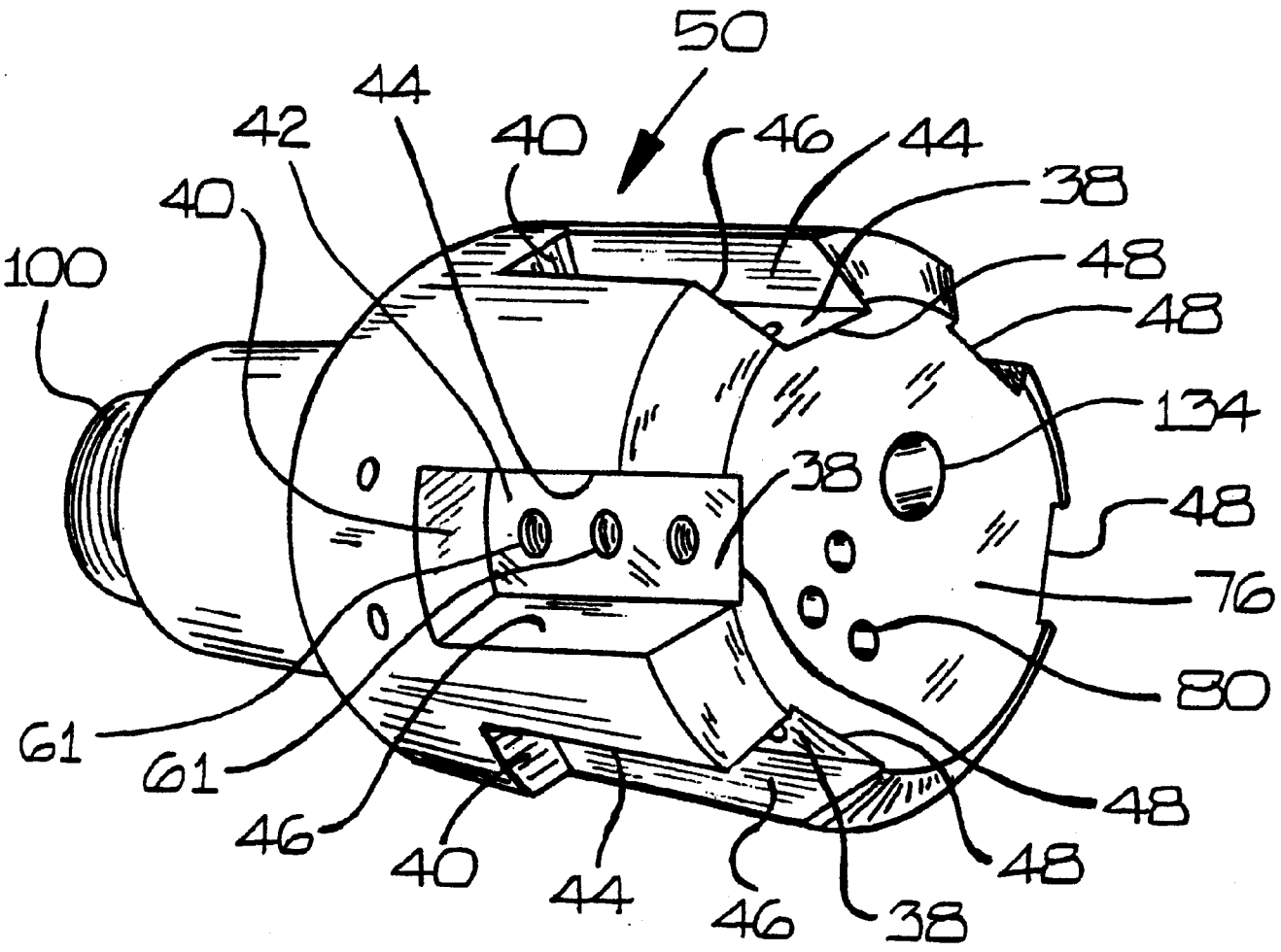
FIG. 8 is a perspective view of the a bit body of a second embodiment of novel drill bit, similar to the bit illustrated in FIGS. 3 through 7 above, but now showing a drill bit body that is utilized for providing a finished assembly for a 17.5 inch diameter drill bit.
Figure 9:
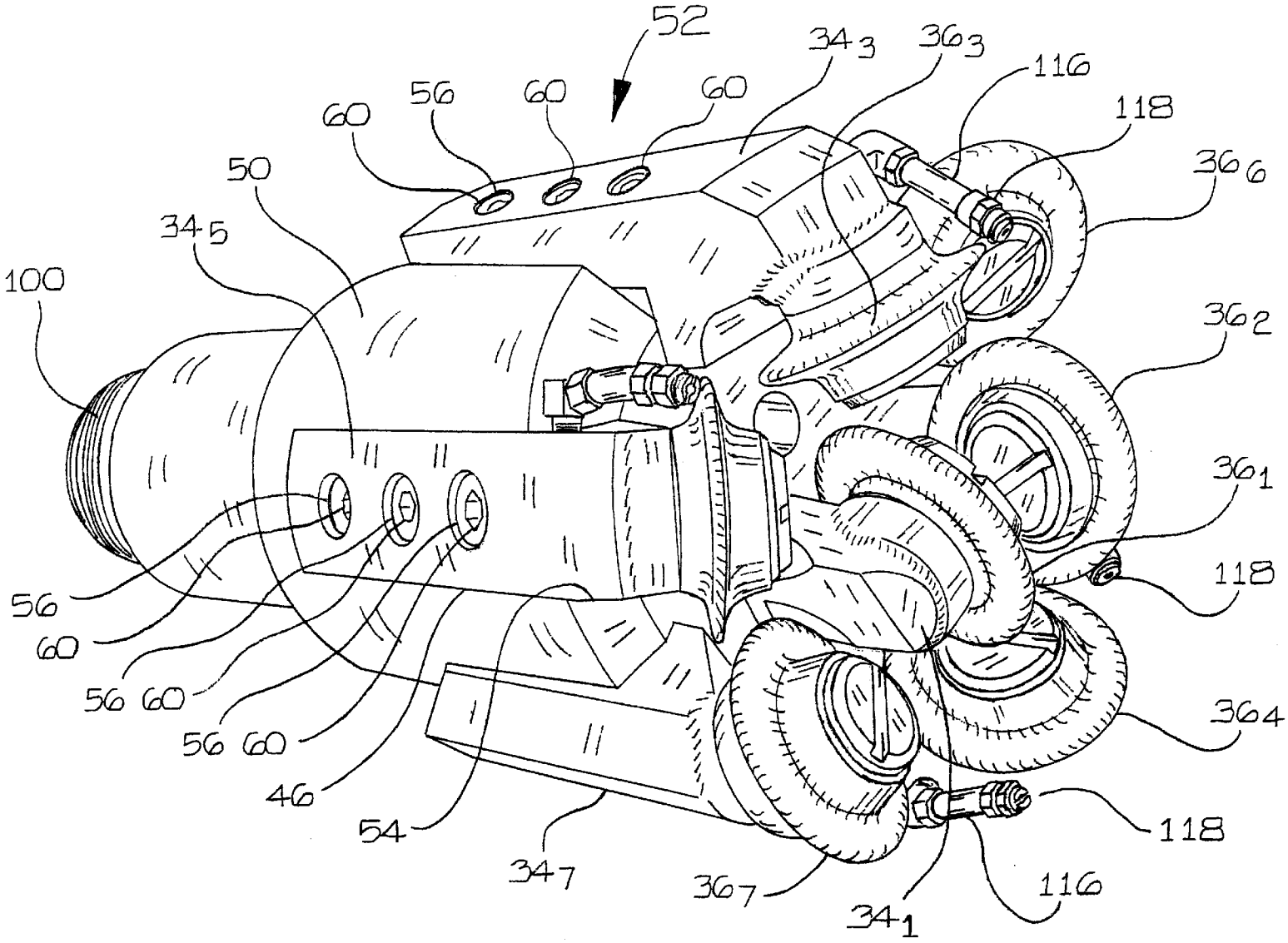
FIG. 9 is a perspective view of a finished drill bit assembly, showing the bit body previously illustrated in FIG. 8, and now showing the attachment of seven rolling type Mini-Disc(tm) brand cutters, as well as water injection nozzles for spraying water to clear cuttings from the cutting path of the drill bit.

Turning now to FIG. 7, the central pedestal $\mathbf{34}_1$, provided for the first cutter assembly $\mathbf{36}_1$, is shown connected to bit body 32 with pin 70 and weldments 72 and 74, since at the bottom 76 (see FIG. 8) of bit body 32, it is very difficult to provide a reliable pedestal installation with cap screws 60 alone for securing the pedestal $\mathbf{34}_1$. Also shown are water jet orifices 80 and 82, as may be utilized in one embodiment where drill cuttings are flushed by this arrangement of high pressure water ejectment toward the cutter assemblies $\mathbf{36}_1$ through $\mathbf{36}_n$ from longitudinally extending fluid passageways 84, 86, and 88.

Figure 5:
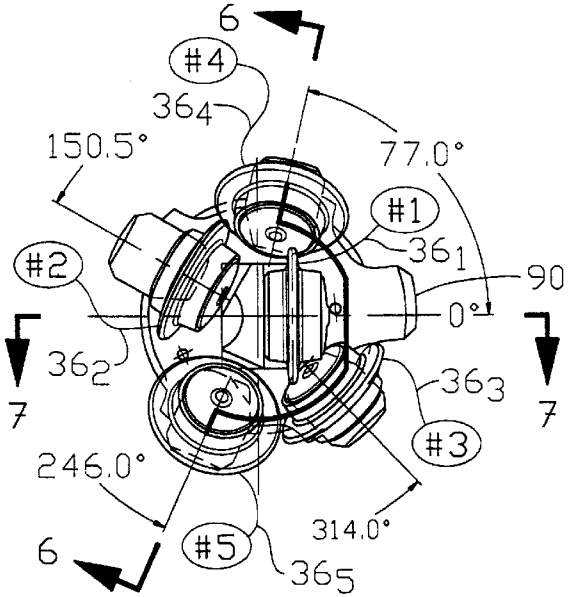
FIG. 5 is a bottom view of the drill bit shown in FIGS. 3 and 4, now showing one preferred layout, including radial angular orientation between the various rolling type Mini-Disc(tm) brand cutters.
Figure 11:
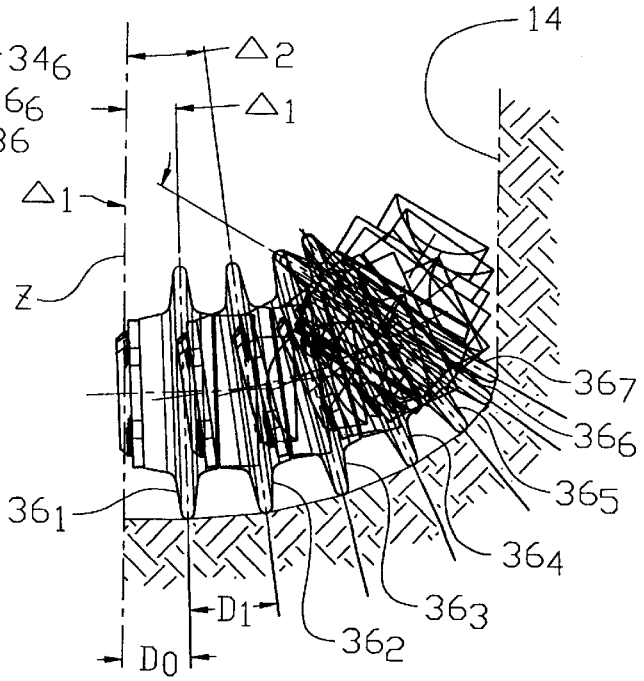
FIG. 11 illustrates a bit profile of the drill bit just illustrated in FIGS. 8, 9, and 10, showing the kerf spacing of the rolling cutters of the bit as applied to the rock in which a borehole is being drilled.
Figure 13:
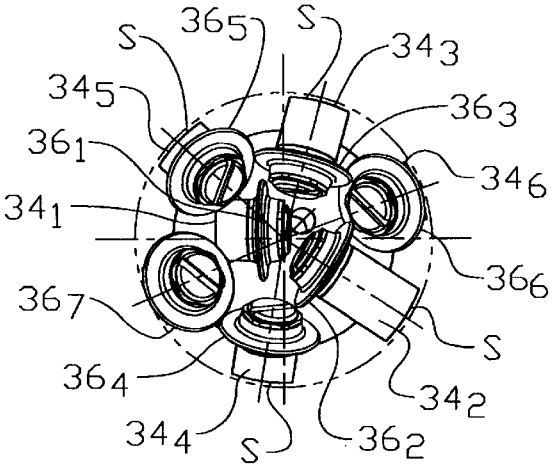
FIG. 13 is a bottom view of the drill bit shown in FIG. 12, now showing the layout of the rolling type Mini-Disc(tm) brand cutters.
Figure 14:
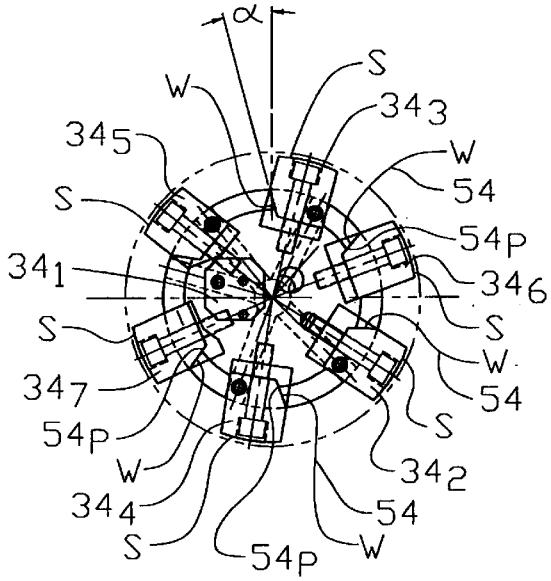
FIG. 14 is a cross-sectional view of the drill bit first shown in FIGS. 12 and 13, taken as if through the section line 14—14 of FIG. 12, looking up and illustrating the bit body and the peripherally mounted detachably affixable pedestal mounts with a rolling type Mini-Disc(tm) brand cutter attached to each pedestal.

Another feature of our invention can be appreciated by reference to FIGS. 3 and 5, where the use of an outwardly protruding bit body shoulder 90 is shown. Shoulder 90 is similar in shape and in radially distal dimension to the downwardly projecting pedestals $\mathbf{34}_1$ through $\mathbf{34}_n$. As is more evident in FIGS. 13 and 14, the radial distal surface S of each of pedestals $^{34}$1 through $^{34}$n is preferably radiused to match the curvature of the borehole being drilled. The shoulder 90 assists bit 30 to track in the borehole, while the rolling disc cutters on the cutter assemblies $\mathbf{36}_1$ through $\mathbf{36}_n$ are positioned in an optimum profile on drill bit 30 and located for best dynamic balance. This is accomplished because the cantilever construction of pedestals $\mathbf{34}_1$ through $\mathbf{34}_n$ requires such a small mounting area that the bit profile, such as shown in FIG. 11 for a larger bit 52 containing 7 rolling disc cutter assemblies $\mathbf{36}_1$ through $\mathbf{36}_7$, can be easily optimized. Moreover, the robust pedestal mounting method permits close kerf (concentric cutter tracks) spacing, in order to provide kerf spacing D (see FIG. 11) of less than one (1) inch, and more preferably, of approximately 0.9 inches.

In one embodiment, the longitudinally extending slots 38 further comprise a wedge shaped sidewall portion 46, and the pedestal mounts have a complimentary angularly shaped portion $\mathbf{54}_p$, so that when the pedestal mount 34 is brought into a close fitting relationship with the longitudinal slot 38, the pedestal mount and the longitudinal slot are tightly and securely interfitting. This angle alpha ($\alpha$) of the wedge, as noted in FIG. 14, can be selected as desired to secure the pedestal mount 34 in the bit body 32.

Figure 10:
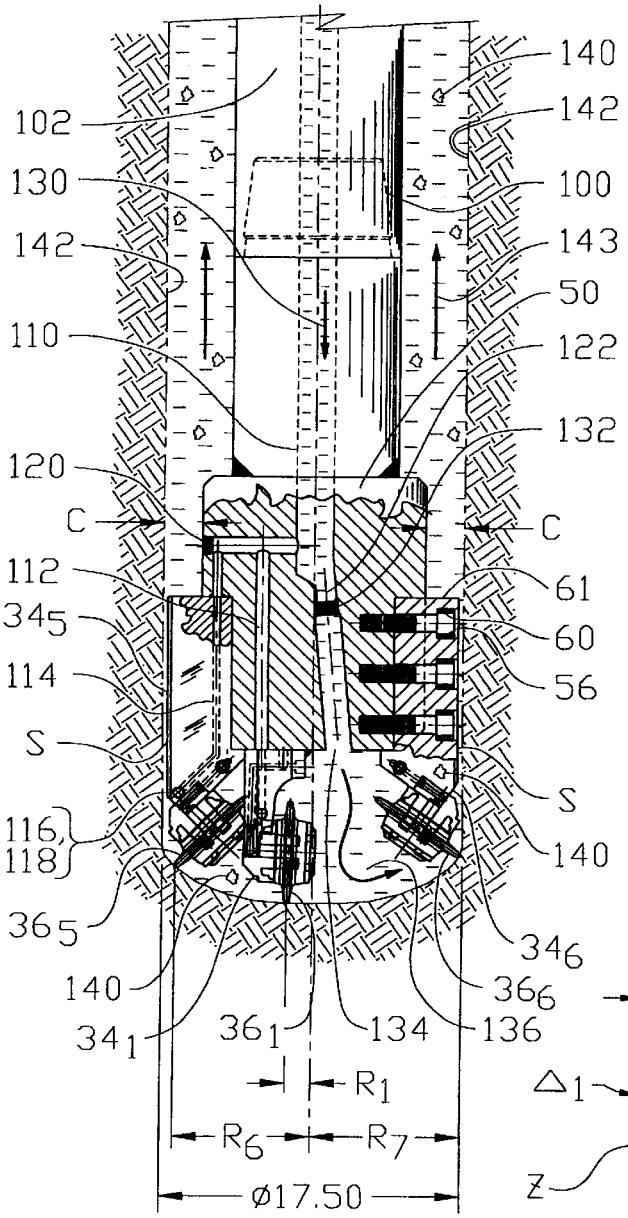
FIG. 10 is a partial vertical cross-sectional view of the drill bit first shown in FIGS. 8 and 9, now showing the drill bit in drilling position in a borehole, and also revealing internal passageways for water injection and cuttings removal, as well as a partial bit profile.

As further noted in FIGS. 10 and 11, at the lower reaches thereof, the pedestal mounts 34 each include at least one small diameter single cutting edge rolling disc cutter. The rolling disc cutters are affixed at individually preselected radially spaced apart locations $R_1$ through $R_n$, where n= the number of rolling disc cutters, with respect to a central longitudinal axis forming the center of rotation of the rotary drill bit. Also, each of the rolling disc cutters is mounted at a preselected angle delta $D_1$ through $D_n$, where n= the number of rolling disc cutters, with respect to the central longitudinal axis forming the center of rotation of the rotary drill bit. The angle delta ranges anywhere from just a few degrees for the inner most rolling cutters, to up to about 45 degrees, or more, for the outermost rolling disc cutters. Also, the rolling disc cutters 36 are preferably detachably affixed to the pedestal mounts 34.

In bit 30, the bit body 32 is provided with a standard machined threaded connection 100, such as a 4.5 inch [11.43 cm] API (American Petroleum Institute) thread, for connection to a drill string pipe 102, similar to that shown for the similar but larger sized threads 100 for bit 52 in FIG. 10.

Figure 12:
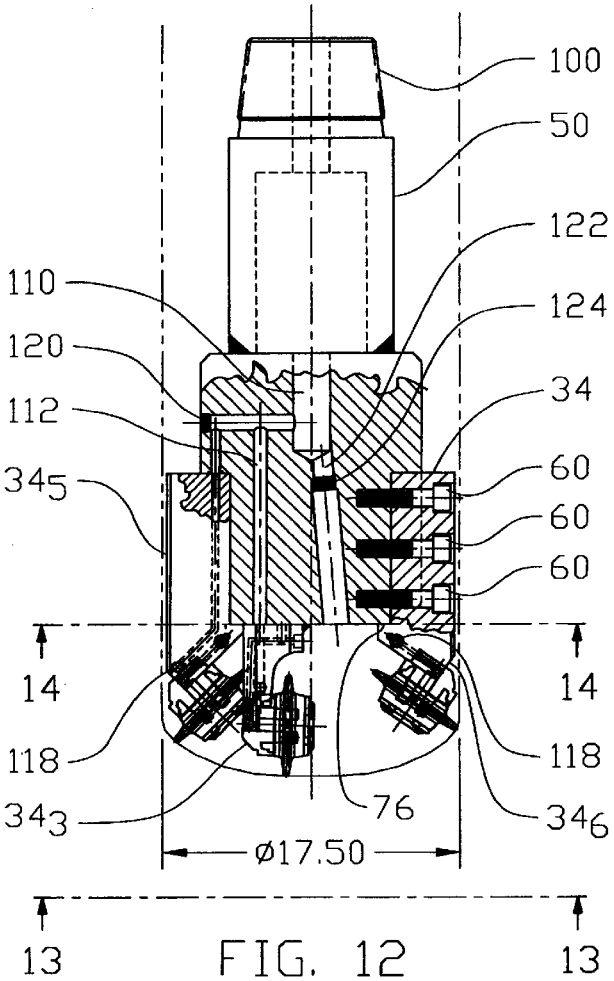
FIG. 12 is a partial side elevation view of our novel drill bit, shown provided in a 17.5 inch [44.45 cm] diameter bit size, utilizing seven rolling Mini-Disc(tm) brand cutters provided by Excavation Engineering Associates, Inc. of Seattle, Wash., with six of the cutters mounted via downwardly extending detachable pedestals, and the seventh cutter detachably mounted on a pedestal welded to the bottom of the bit body.

Turning now to FIG. 12, one embodiment of our drill bit 52 is illustrated, showing the use of longitudinally extending fluid passageways 110 and 112 in the bit body 50, fluid passageways 114 in one or more of the pedestals $\mathbf{34}_1$ through $\mathbf{34}_n$, and outlet piping 116 and high pressure water jet orifice nozzles 118, for directing high pressure water at cuttings, to wash them away from the cutter assemblies $\mathbf{36}_1$ through $\mathbf{36}_n$. In the configuration shown in FIG. 12, a pipe plug 120 is provided, and the center passageway 122 is blanked off by water jet orifice blank 124. Alternately, as advantageously shown by tests of our drill bit 52, the configuration shown in FIG. 10 could be utilized, where high pressure water jets are avoided, and drilling fluid such as water is provided down longitudinal passageway 110, in the direction of reference arrow 130, then through passageway 122, on through orifice 132, and then through outlet 134 and into the drilling cavity 136 to pick up cuttings 140 which are then carried upward in the annulus between drill stem 102 and borehole wall 142 in the direction of reference arrow 143. In such a case, the necessity of passageways 114 in pedestals $\mathbf{34}_n$, and accompanying piping 116 and nozzles 118, can normally be avoided.

Laboratory Testing of Drill Bits

Figure 15:
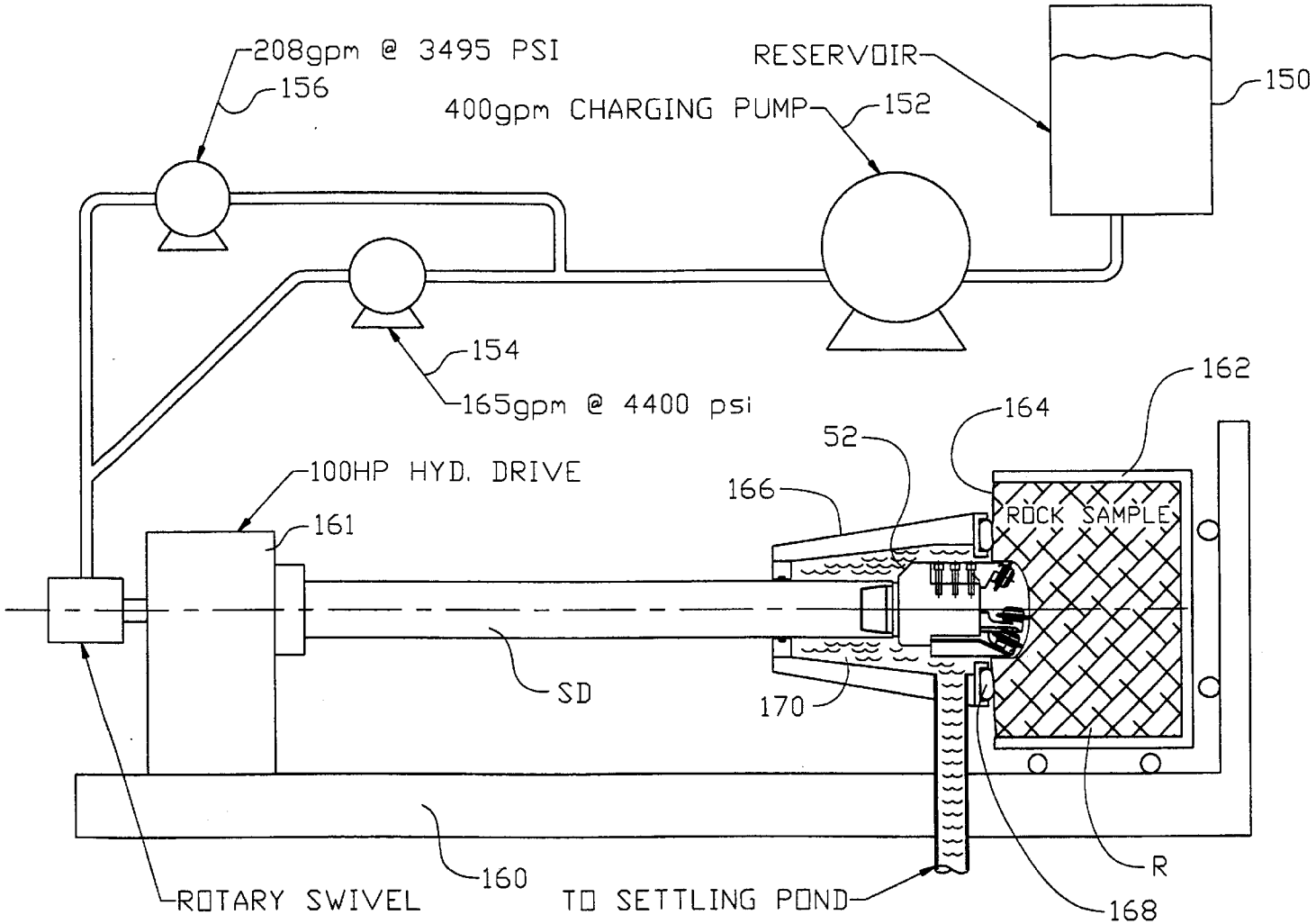
FIG. 15 is schematic of the test set up which was utilized to test my 17.5 inch [44.45 cm] drill bit utilizing rolling type disc cutters.
Figure 18:
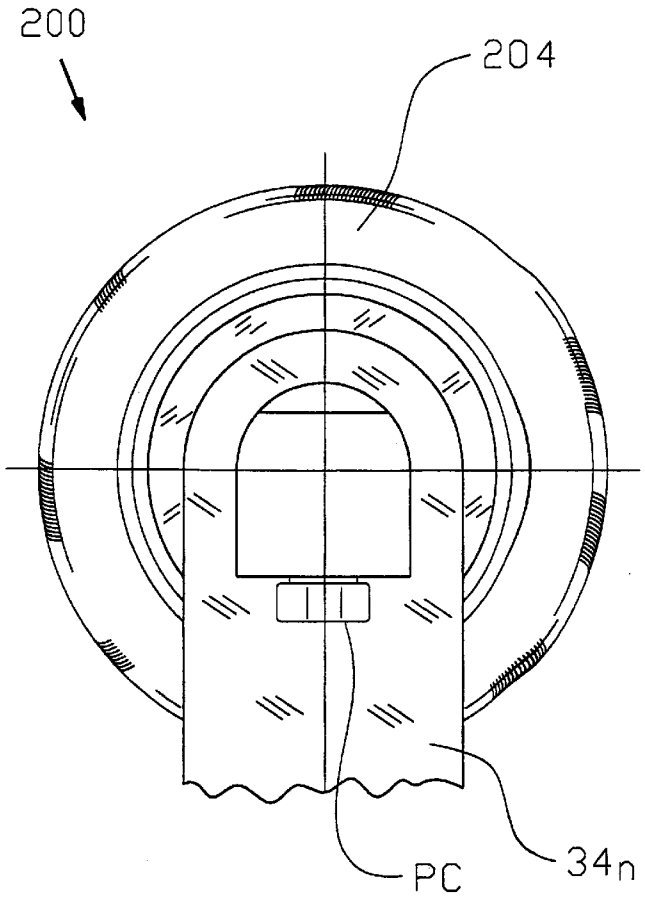
FIG. 18 is a side elevation view of the pedestal mounted rolling disc cutter of the type illustrated in FIGS. 16 or 17, for example.

The initial tests of our new drill bit design were conducted at the Earth Mechanics Institute Laboratory (EMI) of the Colorado School of Mines. A drill test fixture was provided as shown in FIG. 15. A water reservoir 150 was provided to supply a charging pump 152 and dual high pressure, high volume pumps 154 and 156. The drill bit 52 was was set up on the drill test fixture 160, and collared in using low pressure and low volume (36 gpm) [136.2 liters per minute] water flow. A 100 horsepower hydraulic drive unit 161 was used to drive shaft SD to turn the drill bit 52. An initial test was run with low pressure water injection. Individual water jets 118 were all plugged, and a single nozzle 132 was placed in the center injection port. That nozzle 132 was set back into the bit body, as indicated in FIG. 10, so that the pressure drop occurred before the water entered the face cavity 136 at center injection port outlet 134. A rock box 162 held the rock sample 164. A submergence chamber 166 was moved into place and sealed by inflatable tube 168, and the chamber was filled with water 170.

7 ⅞ Inch [20 cm] Diameter Bit

The most common bit size in oil and gas well drilling is 7 ⅞ inches [20 cm] in diameter. We designed and built a bit of that size, and equipped the same with five rolling disc cutters. We prefer to use rolling disc cutters of 3.25 inch [8.25 cm] outside diameter OD. We believe that this size rolling disc cutter is the smallest diameter single cutting edge rolling disc cutter ever made for commercial excavation of rock. The drill bit, as set forth in FIGS. 3, 4, 5, 6, and 7, performed well during initial laboratory testing. In a 23,000 psi compressive strength (UCS) Welded Tuff rock sample R, the drilling rate was 126 ft/hour [38.4 meters per hour], when working with 25,000 pounds weight on bit ("WOB"), and a torque of 2,500 ft-lbs at a rotary speed of 60 rpm.

13 ⅛ Inch [33.35 cm] Diameter Bit

We have also built and tested a 13 ⅛ inch [33.35 cm] diameter drill bit equipped with six rolling disc cutters. We used 5 inch [12.7 cm] outside diameter OD rolling disc cutters on this drill bit. The rolling disc cutters were arranged more or less perpendicular to the rock face, and are set to cut individual concentric kerfs, forming chip-like cuttings in hard rock. With our small rolling disc cutters, we were able to simulate and even improve upon the bit profile and angle with respect to the rock being cut. The 13 ⅛ inch [33.35 cm] diameter drill bit was tested in a 23,000 psi compressive strength (UCS) Welded Tuff rock sample R. With a thrust, or weight on bit (WOB) of 55,000 lbs and a torque of 7,500 ft-lbs at a rotary speed of 58 rpm, a penetration rate of 72 ft/hour [25 meters per hour] was obtained.

17 ½ Inch [44.45 cm] Diameter Bit

Bits of 17 ½ inch [44.45 cm] diameter are common in size for the top segment of a deep oil or gas well, and is also common in geothermal well drilling. Our 17 ½ inch [44.45 cm] diameter bit was equipped with seven single cutting edge rolling disc cutters, each 6 inch in outside diameter OD. The 17 ½ inch [44.45 cm] diameter drill bit was tested in 9,000 psi compressive strength (UCS) Welded Tuff rock sample R. With a thrust of 52,541 pounds (weight on bit, or WOB), and a torque of 10,500 ft-lbs at a rotary speed of 50 rpm, a penetration rate of 326.6 ft/hour [99.5 meters per hour] was obtained. When using a thrust of 45,398 pounds (WOB), the penetration rate was 250.8 ft/hour [76.4 meters per hour].

In addition to the drilling rate performance tests, an experiment to reduce hydraulic horsepower was run. Performance was equivalent, whether multiple high pressure jets, or a single low pressure jet was used to introduce drilling fluid. This is an important and significant development, since current bits require high flow rates of fluid, at high pressure, to obtain reasonable production rates.

Small Diameter Single Disc Rolling Cutter Details

Attention is now directed to FIGS. 16–25, where the various small diameter rolling disc cutters with our novel and advantageous bearing and seal configurations are set forth. Such unique bearing and seal arrangements make it possible to reliably take maximum advantage of our small diameter drill bit by using small diameter rolling cutters.

Figure 16:
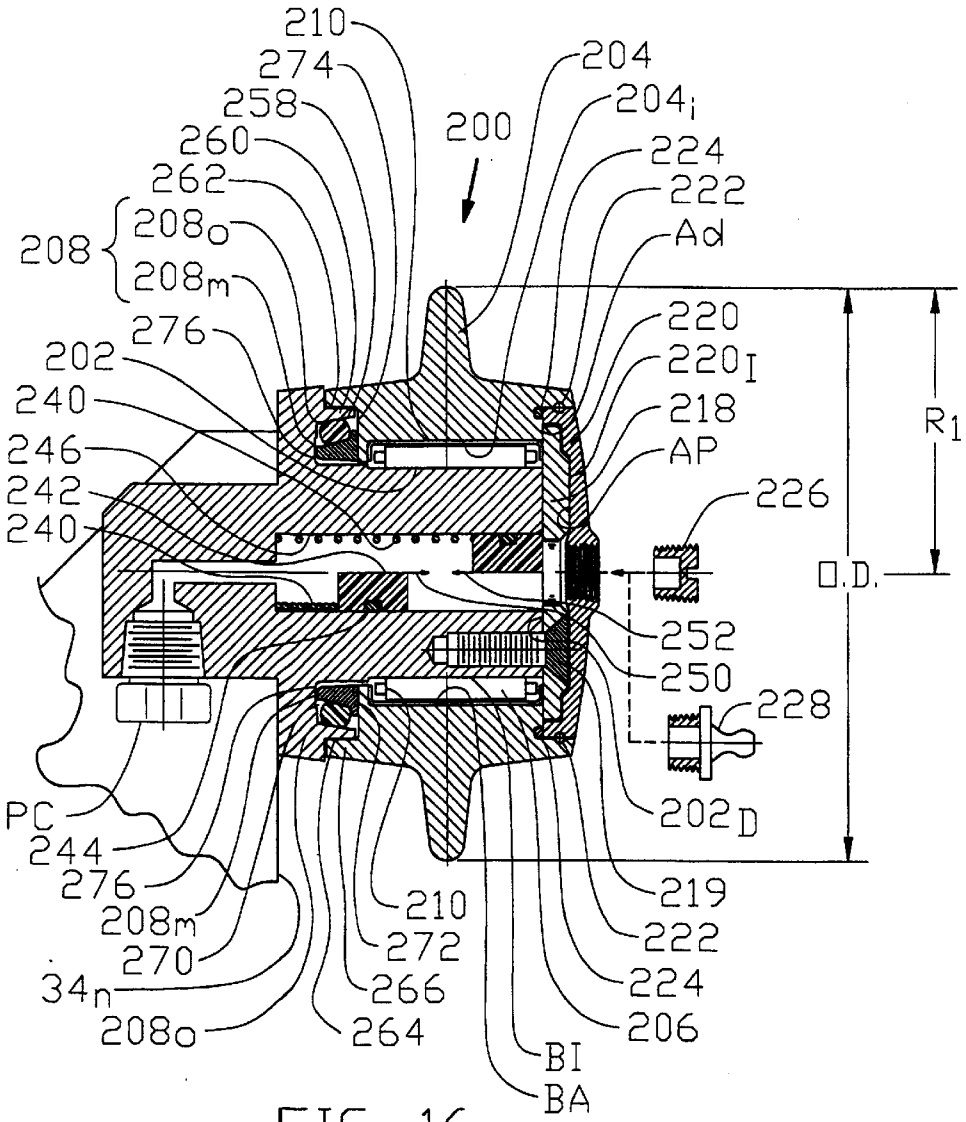
FIG. 16 is a cross-sectional view of a single cutting edge type rolling disc cutter, using a needle bearing and a single wear ring type seal, shown using a spring type pressure compensator along the shaft centerline.

First, as noted in FIG. 16, a typical small diameter cutter 200 preferably has a relatively large diameter shaft 202. Cutter ring 204 rotates about shaft 202, with a bearing assembly 206 and a seal assembly 208 located between the fixed shaft 202 and the interior side $\mathbf{204}_i$ of rotating cutter ring 204. The bearing assembly 206 includes needle bearings 210. The bearing assembly 206 has an outer diameter BA and an inner diameter BI. The thickness between outer diameter BA and inner diameter BI should be as thin as is feasible; the example given is using Torrington type B-1916 needle bearings 210. Retainer 218, secured by hubcap 220, secures bearing assembly 206 in place. Preferably, retainer 218 is also located and secured to the distal end $\mathbf{202}_D$ of shaft 202 by one or more fasteners such as screws 219.

Importantly, retainer 218 also functions as a double acting thrust bearing. This is because axial loads toward the distal end are reacted by the surface $A_d$ and toward the proximal or mounting end by surface $A_p$. The reaction surface at $A_p$ is against the inside surface $\mathbf{220}_I$ of hub cap 220. Hub cap 220 is secured by lockwire 222, such as 0.06" retaining wire, and is sealed with O-ring 224, such as a Parker O-ring stock number 2-031. This configuration provides an inwardly facing seal assembly 208, having o-ring $\mathbf{208}_O$ and metal wear ring $\mathbf{208}_m$, and is able to minimize axial or thrust loading on the seal assembly 208. A pipe plug 226 closes hubcap 220, and may be removed for adding lubricant to the disc cutter assembly as shown, for example, in FIG. 17 and similarly is indicated in various other figures. Alternately, a zerk type fitting 228 may be used for addition of lubricant. The side view of the embodiment just shown in FIG. 16 is revealed in FIG. 18, now showing the pressure compensator port PC and the mounting pedestal $\mathbf{34}_n$.

Figure 21:
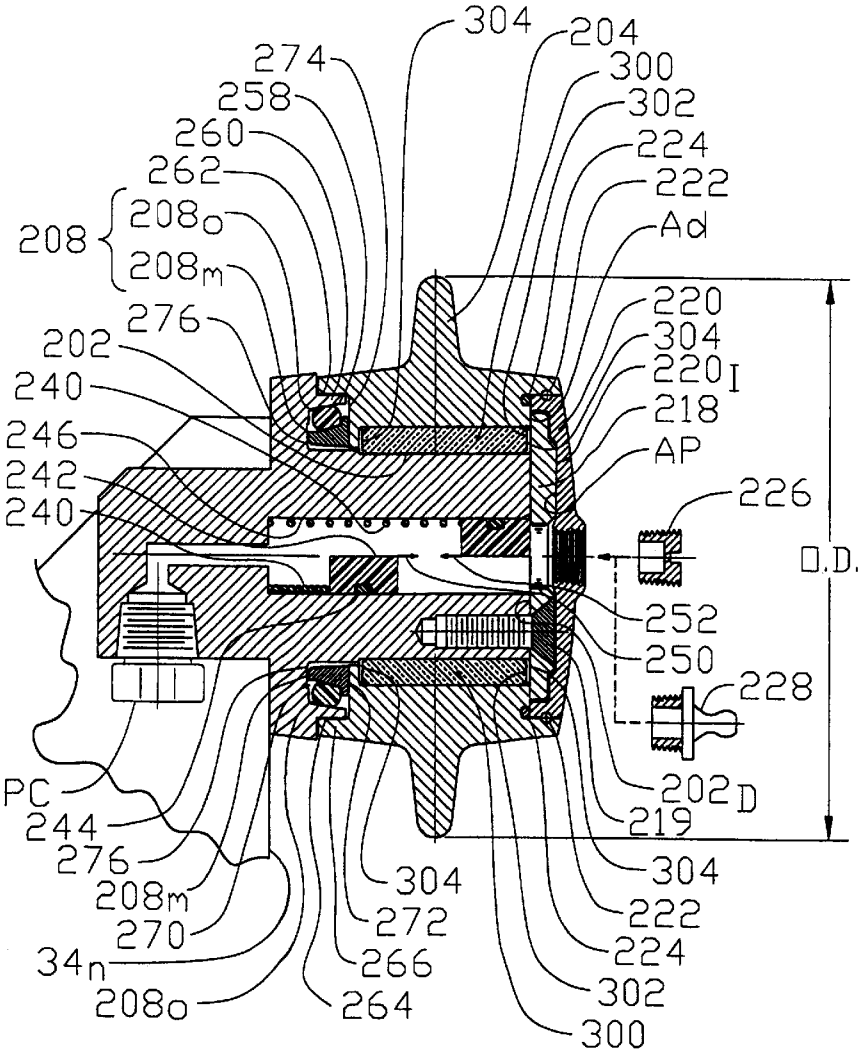
FIG. 21 is an alternate embodiment, similar to that just illustrated in FIG. 20, now showing the use of a journal bearing with spiral oil groove, the use of an oil groove in the retainer, and also using a spring-piston type pressure compensator located along the center line of the shaft.
Figure 22:
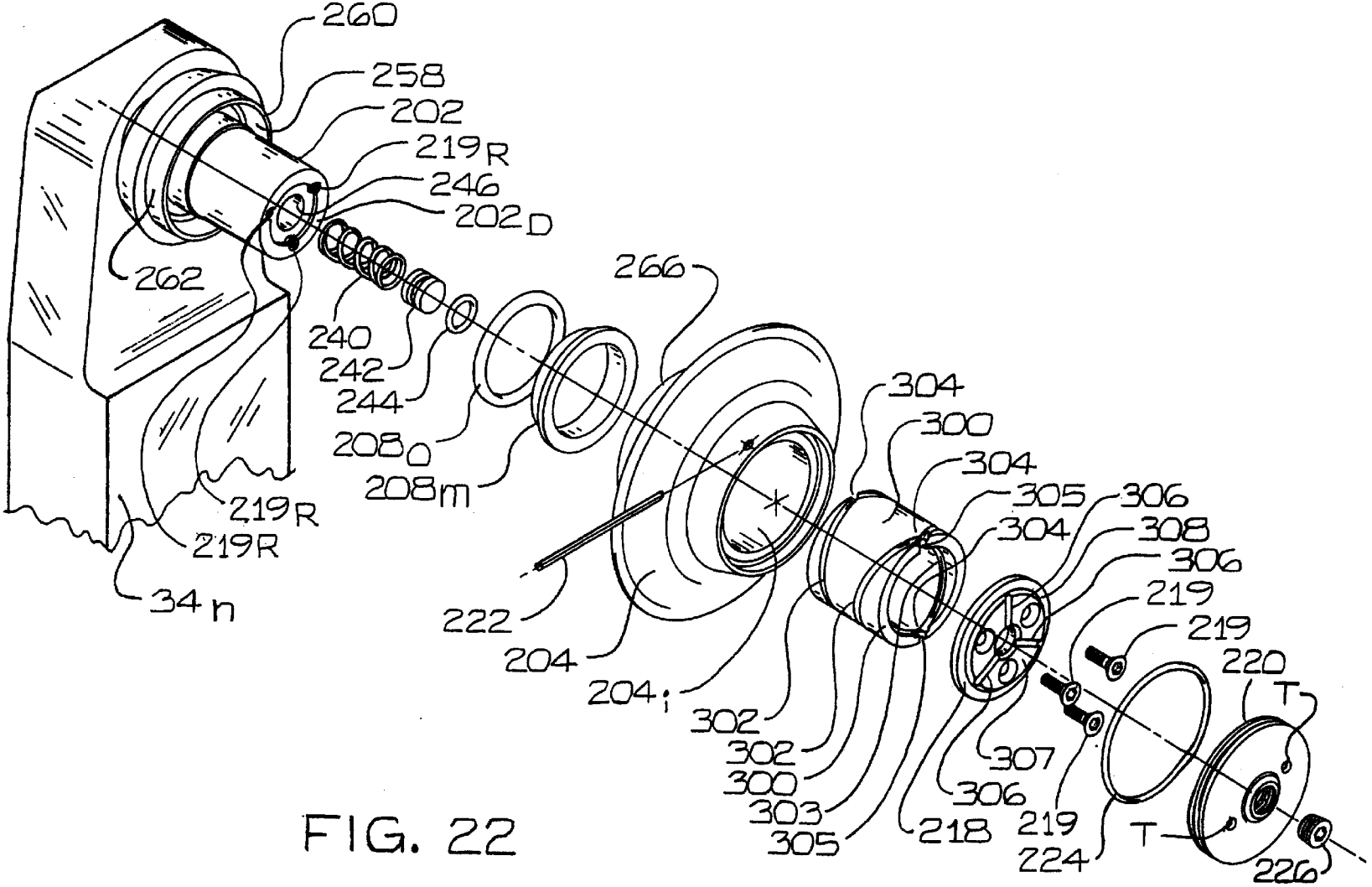
FIG. 22 is an exploded perspective view of the embodiment just illustrated in FIG. 21 above, now showing the use of a cylindrical journal bearing with oil grooves, a bearing retainer with oil grooves.

In the embodiment shown in FIGS. 17, 19, 20, and 23, a small disc cutter with an outside diameter OD of 3.25 inches is illustrated with a bellows B type pressure compensator arrangement. Alternately, as illustrated in FIGS. 16, 21, and 22, a spring 240 actuated piston 242 is provided. In this configuration, a cylindrically shaped piston 242 ideally utilizes a centrally located O-ring 244 to seal against an interior annular surface 246 axialy located in the shaft 202. As illustrated in FIGS. 16 and 21, spring 240 is hypothetically shown split to illustrate an extended position at the upper portion of the annular surface 246 and to illustrate a compressed spring 240 at the lower portion of the annular surface 246. Reference arrows 250 and 252 indicate the direction of motion of the piston 242 from the compressed and extended positions, respectively.

In FIGS. 16, 17, 19, 21, and 22, it is important to note that the seal assembly 208 comprises an o-ring $\mathbf{208}_O$ and an inwardly facing chevron shaped hard metal sealing ring $\mathbf{208}_m$, which enables the O-ring $\mathbf{208}_O$ to seal against the inner side 258 of a generally horizontally and distally extending (with respect to shaft 202) stationary ring flange 260. The stationary ring flange 260 is preferably is integrally formed with, or is integrally machined from, shaft 202 material to assure adequate strength. In the illustrated configuration, the ring flange 260 has an upper surface 262 that is overlapped by the lower surface 264 of a generally horizontally and proximally (with respect to shaft 202) projecting seal shoulder 266 of cutter ring 204. This configuration provides an external labyrinth type seal, between seal shoulder 266 and ring flange 260, in addition to stationary seal assembly 208, in the general shape of a question mark ("?") with the flange 260 projecting into the cup of the mark, and the stem extending circumferentially radially outward. It is an advantage of this configuration that the proximal side 270 of sealing ring $\mathbf{208}_m$ and the distal side 272 of sealing ring $\mathbf{208}_m$ can function as a stop and bear the axial loads between the inside 274 of cutter ring 204 and the outwardly facing seal wall 276 which is located between, and spaces apart, the shaft 202 and the ring flange 260. This is a unique seal and axial thrust loading technique for disc cutters, and this configuration enables reliable operation with such small disc cutter sizes that we prefer, such as less than about 6 inches outside diameter OD, and preferably of about 5 inches outside diameter OD or less, and more preferably of about 3 and one-quarter inches OD, more or less.

Figure 19:
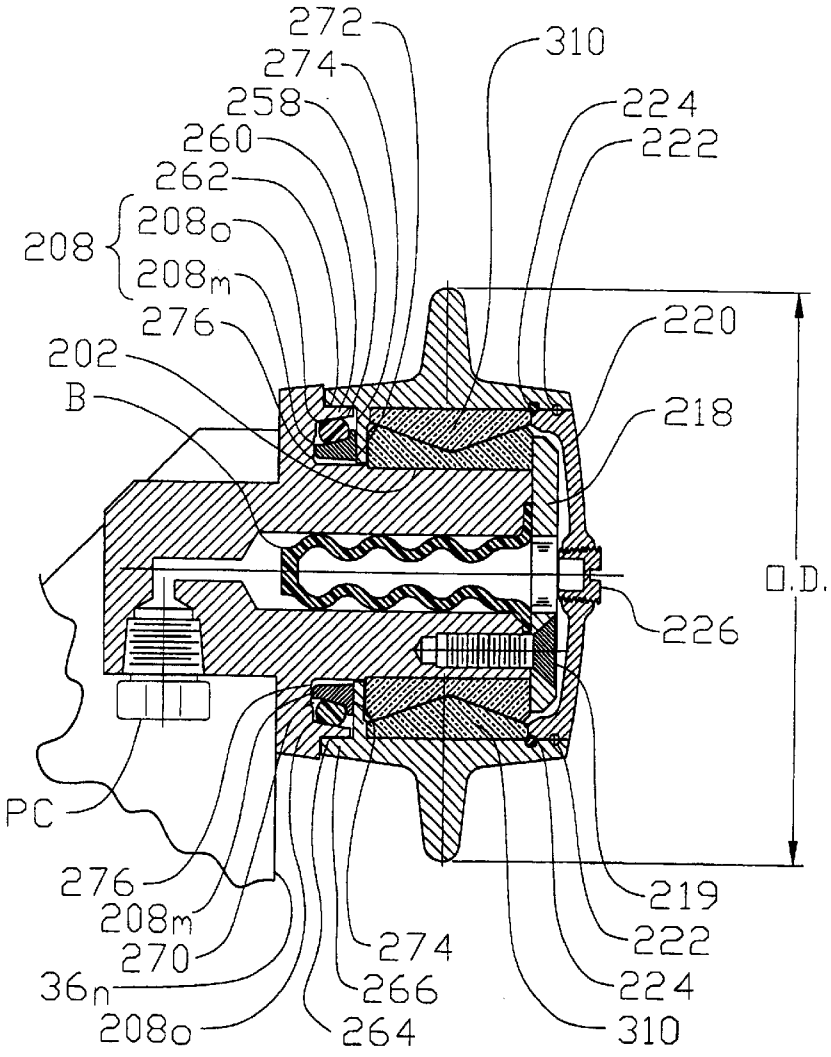
FIG. 19 shows a cross-sectional view of a rolling disc cutter which uses a tapered journal bearing, as well as internal bellows type pressure compensator, as well as the retention of the hubcap via use of an internal retaining wire structure.
Figure 17:
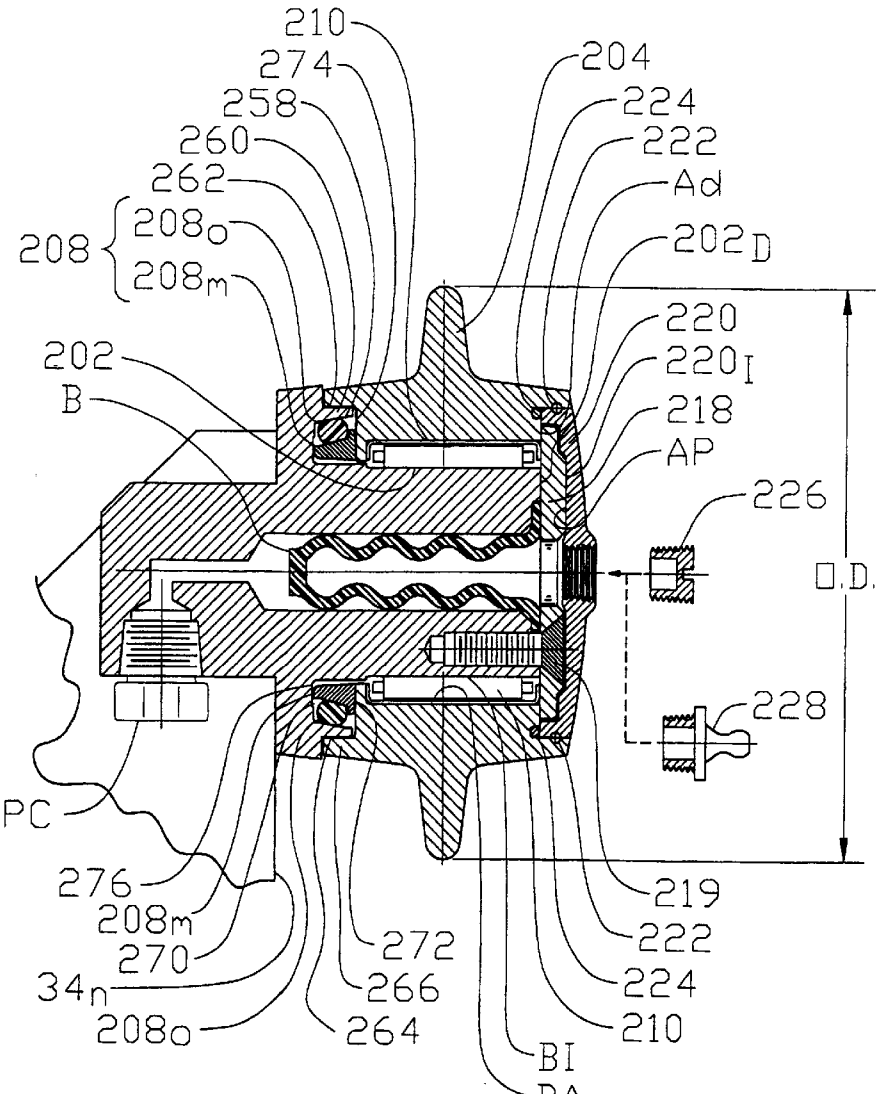
FIG. 17 is an alternate embodiment, similar to that just illustrated in FIG. 16 and also utilizing a single wear ring type seal with o-ring, but now using a bellows type pressure compensator along the shaft centerline.
Figure 20:
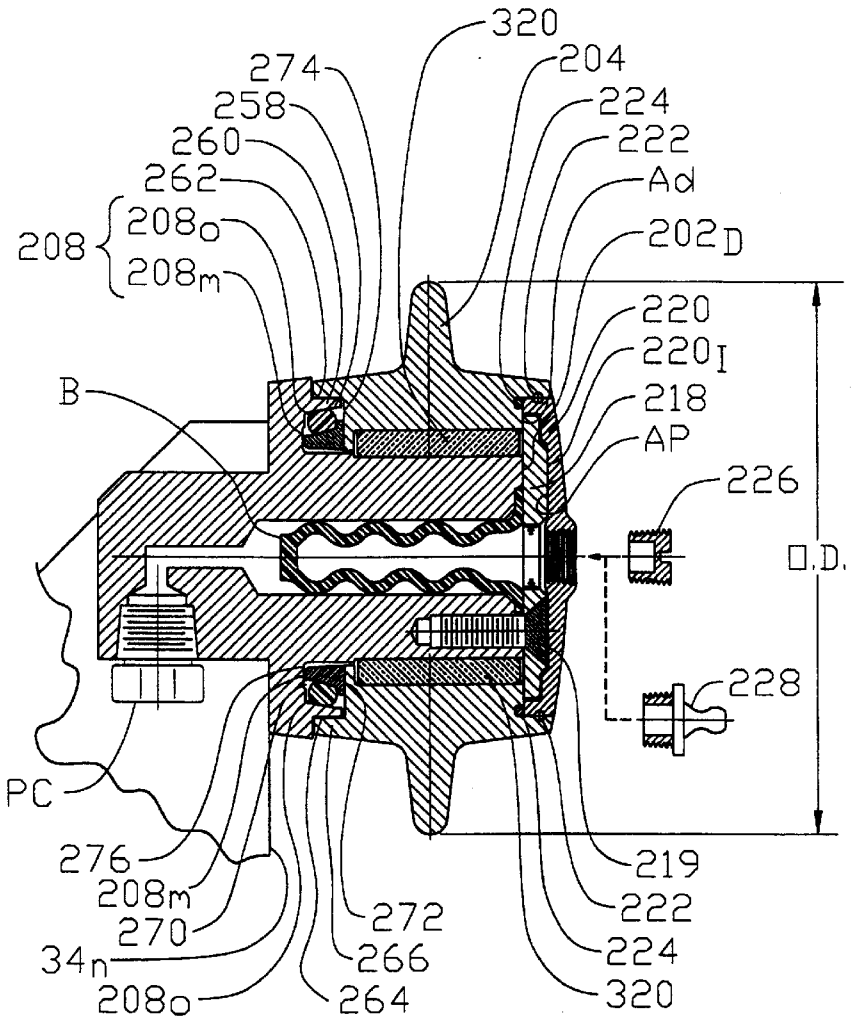
FIG. 20 illustrates the use of a flat (annular shaped) journal bearing in a rolling type disc cutter, as well as the retention of the hubcap via use of an internal retaining wire structure.

In FIG. 19, a tapered journal bearing 310 is depicted, using a split V-shaped design. However, labyrinth seal (flange 260 and seal ring 266) and seal assembly 208 are still utilized, as just described above.

In FIGS. 20, 21, 22, and 23, the use of a journal type bearing assembly 320 is utilized. Note that in FIG. 20, the rolling disc cutter illustrated utilizes a flat (annular shaped) journal bearing 320. However, in FIGS. 21 and 22, a more preferred embodiment is shown, where the journal bearing 300 has one or more exterior split spiral oil grooves 302, interior oil grooves 303, and a plurality of oil entry ports 304 defined by U-shaped edge walls 305, preferably located at the lateral edges of journal bearing 300. Also, the use of a plurality of oil grooves 306 on the outer face 307 of the retainer 218 (preferably at least three or more and most preferably ending before peripheral lip 308 of retainer 218 is reached, radially) helps assure that adequate lubrication is available to enable rolling cutter 204 to rotate relatively friction free with respect to the shaft 202. In this FIG. 22, the threaded apertures $\mathbf{219}_R$ adapted to receive fasteners 219 that secure the retainer 218 to the distal end $\mathbf{202}_D$ of shaft 202. For removal of retainer 218, tool recesses T are provided.

Figure 23:
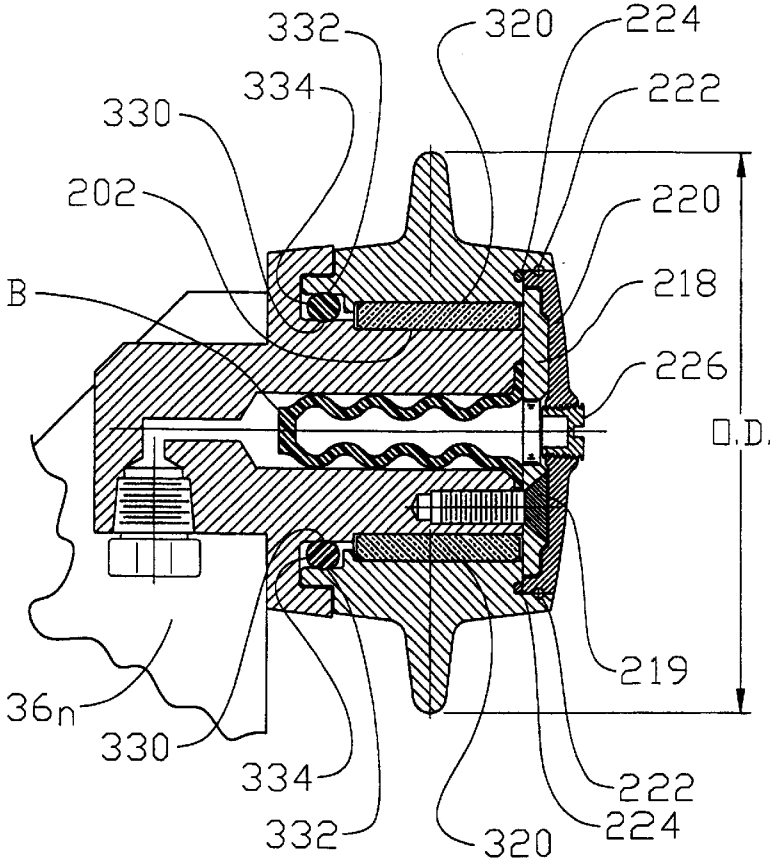
FIG. 23 shows a cross-sectional view of a rolling disc cutter which uses a single o-ring type seal with integral, V-shaped complementary mating surfaces on the rolling cutter wear ring and on the shaft for accepting and locating the o-ring.

In FIG. 23, the shaft and the cutter ring each provide seal lands, 330 and 332, respectively, preferably rather V-shaped or opposing U-shaped, and the seal comprises an o-ring 334 interfittingly sealed at lands 330 and 332, thus containing the lubrication therebehind. Also, in this FIG. 23, needle bearings such as bearings 210 noted above, as well as the journal bearings 320 as illustrated, can be utilized in the bearing assembly.

Figure 25:
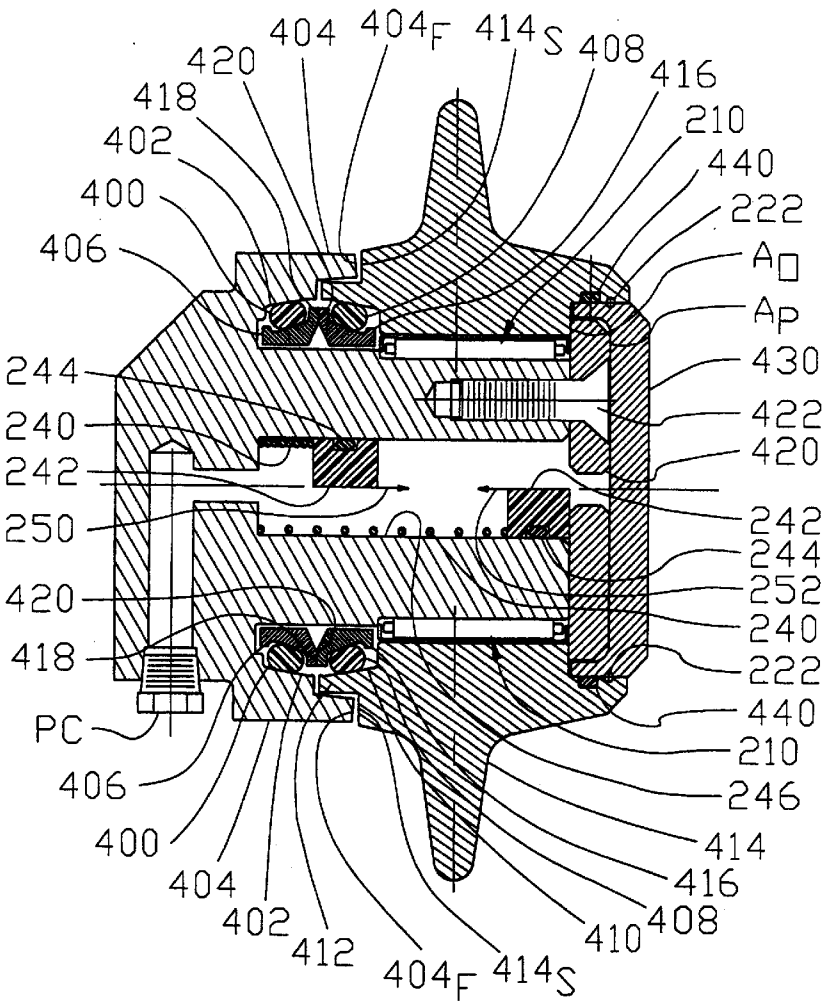
FIG. 25 shows the use of a double wear ring type seal, as well as use of a needle bearing and a thrust bearing retaining ring structure which acts against a thrust resistant hubcap structure.
Figure 24:
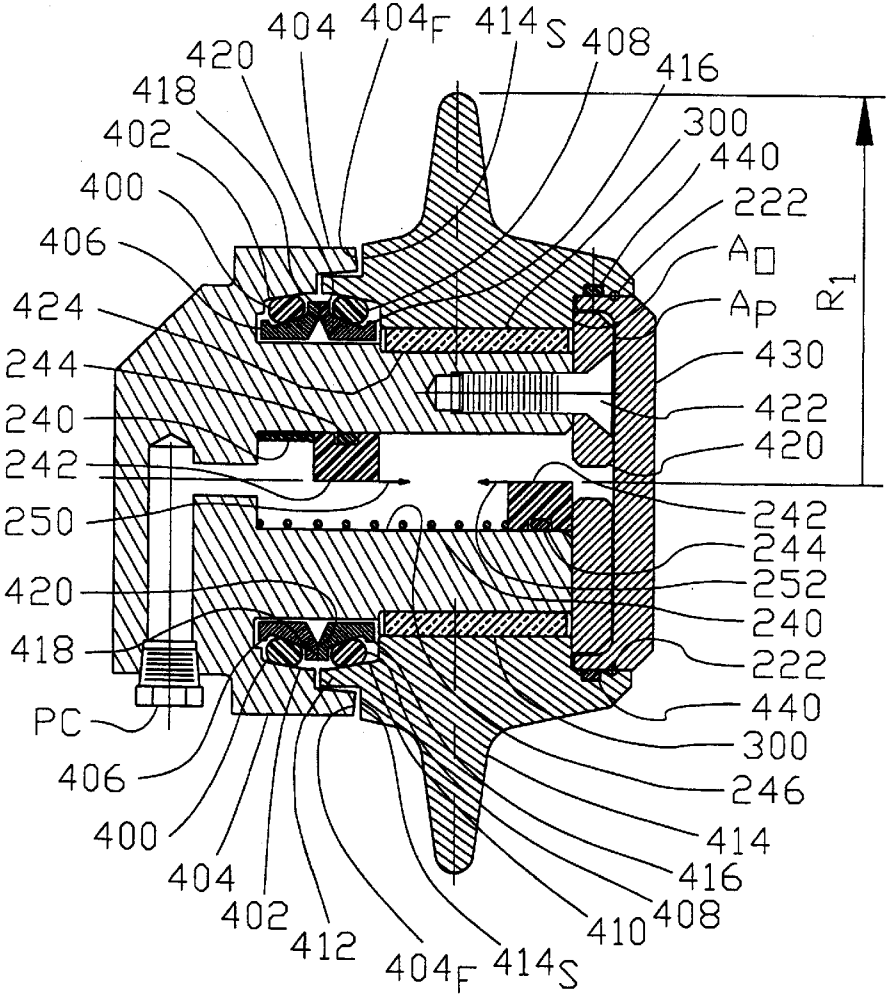
FIG. 24 shows the use of a double wear ring type seal, as well as the use of a journal bearing with spiral oil grooves and oil entry orifices at the sides of the bearing, showing in combination with a spring/piston type pressure compensator and a thrust bearing retaining ring structure which acts against a thrust resistant hubcap structure.

FIGS. 24 and 25 show a disc cutter with a metal-to-metal full face type seal, where a first o-ring 400 protects and seals inner wall 402 of flange 404 with the stationary 406 metal chevron ring, and a second o-ring 408 seals inner seal wall 410 of the sealing flange 412 of cutter ring 414 against the traveling metal chevron ring 416. Wear and thrust is between the outer surface 418 of stationary wear ring 406, and the inner surface 420 of travelling metal ring 416. Entry face $\mathbf{404}_F$ of stationary flange 404, and entry shoulder $\mathbf{414}_S$ of cutter ring 414 form there between a tapered labyrinth entry to the seal assembly therebehind, as just described. This type of metal-to-metal full face type seal is normally used in our relatively large diameter disc cutters.

In FIG. 24, a double slip type journal bearing 300 is shown, and in FIG. 25, a needle bearing 210 is shown. Also illustrated in these two figures is a unique configuration for a retainer 420, which is secured by multiple fasteners 422 screwed into the shaft 424. The hubcap 430 turns against the retainer 420, and axial thrust is accommodated as described above with respect to the retainer 218 and hub cap 220 in FIG. 16, or as similarly illustrated in FIG. 21. An elastomeric seal 440 and retaining wire 222 are used to seal and retain the hubcap 430.

In summary, it can be readily appreciated that our novel drill bit, utilizing our uniquely shaped single cutter blade rolling disc type cutters are not to be limited to a particular mounting technique, but may be employed in what may be the most advantageous mount in any particular application. Also, although we have illustrated the use of a shaft mounted spring or bellows type pressure compensator, it will be understood by those of ordinary skill in the art and to whom this specification is addressed that a pedestal mounted pressure compensator can be utilized in lieu of the shaft mounted pressure compensators shown, generally as described in U.S. Pat. No. 5,626,201 mentioned above.

Similarly, although the research connected with the development of our novel drill bit demonstrated the advantages of using the small diameter single cutting edge rolling type cutters in such applications our novel drill bit can be assembled in any desired diameter via use of rolling cutters of a suitable diameter. Importantly, such drill bits can be assembled in sizes to fit into existing drill rigs.

Therefore, it is to be appreciated that the drill bit provided by the present invention is an outstanding improvement in the state of the art of borehole drilling, and in other excavation requirements requiring small hole boring. Our novel drill bit employs our novel, small diameter rolling type disc cutters, is relatively simple, and is easy to service. Importantly, our novel drill bit dramatically increases the drilling rate at a given thrust. Also, we believe that our novel drill bit will substantially reduce the cost of maintaining and rebuilding of drill bits, since our design is relatively simple to field rebuild.

It is thus clear from the heretofore provided description that our novel drill bit, and the method of mounting and using the same in a drilling, is a dramatic improvement in the state of the art of borehole drilling. It will be readily apparent to the reader that the our novel drill bit may be easily adapted to other embodiments incorporating the concepts taught herein and that the present figures as shown by way of example only and are not in any way a limitation. Thus, the invention may be embodied in other specific forms without departing from the spirit or essential characteristics thereof. The embodiments presented herein are therefore to be considered in all respects as illustrative and not restrictive, the scope of the invention being indicated by the appended claims rather than by the foregoing description, and all changes which come within the meaning and range of equivalences of the claims are therefore intended to be embraced therein, including all structural equivalents, or equivalent structures.

What is claimed is:

1. A drill bit for use in drilling a well bore of preselected diameter, said bit comprising:

(a) a bit body, said bit body adapted to be rotated about a longitudinal axis of rotation, said bit body further comprising
a bottom, and
a plurality of peripheral longitudinal slots, said longitudinal slots located at pre-selected angularly spaced apart locations, said longitudinal slots comprising
(i) an upper ledge,
(ii) a bottom wall, said bottom wall extending longitudinally to said bottom of said bit body,
(iii) a first substantially radially inward sidewall,
(iv) a second sloping wedge shaped sidewall;

(b) a set of peripheral pedestal mounts, each of said peripheral pedestal mounts comprising (i) a first straight inward sidewall adapted to mate with said first sidewall of said longitudinal slot, (ii) a sloping wedge shaped sidewall adapted to mate with said second sidewall of said longitudinal slot so as to securely wedge said pedestal mount in said bit body, and (iii) a radially inward side, said radially inward side adapted to fit into said longitudinal slots in a close, securely interfitting fashion with said bottom wall of said longitudinal slot;

(c) each of said peripheral pedestal mounts further comprising a small diameter single cutting edge rolling disc cutter, said rolling disc cutter affixed to said peripheral pedestal mount at a pre-selected radial location on said bit body, and mounted at a preselected angle delta with respect to said longitudinal axis.

2. The drill bit as set forth in claim 1, further comprising an interior pedestal mount, said interior pedestal mount affixed to said bottom of said bit body.

3. The drill bit as set forth in claim 2, further comprising a single cutting edge type rolling disc cutter affixed to said interior pedestal mount.

4. The drill bit as set forth in claim 3, wherein said rolling disc cutter is spaced radially outward from said longitudinal axis of rotation.

5. The drill bit as set forth in claim 1, wherein each of said rolling disc cutters is one of a set of rolling disc cutters comprising a series of cutters in the set 2, 3, . . . n−2, n−1, n, wherein n is a positive integer.

6. The drill bit as set forth in claim 5, wherein n is 5, 6, or 7.

7. The drill bit as set forth in claim 1, wherein in said peripheral pedestal mounts are detachably affixed to said bit body.

8. The drill bit as set forth in claim 1 or claim 2, wherein said rolling type disc cutters are detachably affixed to said pedestal mounts.

9. The drill bit as set forth in claim 1, wherein said longitudinally extending slots further comprises a wedge shaped edge portion, and wherein said peripheral pedestal mounts further comprise a complimentary angularly shaped portion, so that when said peripheral pedestal mount is brought into said close fitting relationship with said longitudinal slot, said peripheral pedestal mount and said longitudinal slot are tightly and securely interfitted.

10. The drill bit as set forth in claim 1, further comprising a longitudinally extending, central fluid passageway, said central fluid passageway adapted to receive a drilling fluid therethrough for discharge out said bottom of said drill bit.

11. The drill bit as set forth in claim 1, wherein said drill bit has a cutting diameter of 17.5 inches (44.45 cm) or less, and wherein said rolling disc cutter is a true rolling circular disc cutter forming a circular kerf by penetration into a face being drilled, to fracture solid matter between a proximate pair of said kerfs to produce chips which separate from said face, and wherein said each of said rolling disc cutters further comprise:

(a) a relatively stiff shaft, said shaft having a proximal end and a distal end, an axis for rotation thereabout, and a seal receiving portion;

(b) a cutter ring assembly, said cutter ring assembly further comprising (i) an annular cutter ring having an interior annulus defining portion and an outer ring portion, said outer ring portion including a cutting edge having diameter OD and radius $R_1$ (ii) a bearing assembly, said bearing assembly adapted (A) to substantially fit into said annulus of said cutter ring, and (B) in a close fitting relationship with said shaft, so that said cutter ring may rotate with respect to and be supported by said shaft, (iii) said bearing assembly comprising (A) a bearing, and (B) a seal assembly, said seal assembly adapted to fit sealingly between said cutter ring and said seal receiving portion of said shaft, so as to form a lubricant retaining seal for said interior annulus portion of said cutter ring, (c) a retainer assembly, said retainer assembly adapted to retain said cutter ring assembly onto said shaft, (d) a cap, said cap having an interior surface portion, said cap adapted to seal said interior annular portion of said cutter ring assembly, so that, in cooperation with said seal assembly and said cutter ring, a lubricant retaining chamber is provided.

12. The drill bit as set forth in claim 11, wherein said rolling type cutter comprises a cutter ring with an outside diameter of 6 inches (15.25 cm) or less.

13. The drill bit as set forth in claim 12, wherein said rolling type cutter comprises a cutter ring having an outside diameter of less than 4 inches (10.16 cm).

14. The drill bit as set forth in claim 13, wherein said rolling type cutter comprises a cutter ring having an outside diameter of approximately 3.25 inches (8.25 cm).

15. The drill bit as set forth in claim 11, wherein said bearing comprises a journal type bearing.

16. The drill bit as set forth in claim 11, wherein said bearing comprises a needle type bearing.

17. The drill bit as set forth in claim 11, wherein said bearing comprises a tapered journal type bearing.

18. The drill bit as set forth in claim 11, wherein said bearing comprises a journal type bearing with spiral oil groove passageways therein.

19. The drill bit as set forth in claim 11 wherein said seal assembly comprises a full face, metal to metal type seal.

20. The drill bit as set forth in claim 11, wherein said seal assembly comprises a half-face, metal seal ring to cutter ring seal.

21. The drill bit as set forth in claim 11, wherein said seal assembly comprises a single or half-face type seal.

22. The drill bit as set forth in claim 11, wherein said cutting edge portion of said cutter ring further comprises a smoothly curved contact portion in transverse cross-section.

23. The drill bit as set forth in claim 22, wherein said transverse cross-section is symmetrical in shape.

24. The drill bit as set forth in claim 11, wherein said apparatus further comprises (a) a bore defining interior sidewall running generally axialy through at least a portion of said shaft to an opening at the distal end thereof, and (b) a compensator, (c) wherein the bore defined by said sidewall serves as a lubricant reservoir, said reservoir in fluid communication with (i) said lubricant retaining chamber and (ii) with said compensator, so that in response to external fluid pressure such as water pressure acting on said compensator, the pressure of said lubricant in said lubricant retaining chamber is substantially equalized to said external pressure, so as to prevent said external pressure causing fluid from tending to migrate into said lubricant retaining chamber.

25. The drill bit as set forth in claim 11, wherein each cutter ring assembly is sufficiently lightweight that it is manually portable by a single worker.

26. The cutter as set forth in claim 25, wherein said cutter ring assembly is 20 lbs. (9.07 kg) or less.

27. The cutter as set forth in claim 25, wherein said cutter ring assembly is 8 lbs. (3.63 kg) or less.

28. The drill bit as set forth in claim 1, (a) wherein said bit body further comprises a lower retaining portion, and (b) wherein at least one of said peripheral pedestal mounts further comprises a lower inwardly extending lip portion, and (c) wherein said lip portion sits over said retaining portion so that forces acting against pedestals are transmitted to said bit body.

29. The drill bit as set forth in claim 1, wherein said bit body further comprises threaded fastener receptacles disposed along said bottom wall of said longitudinal slots, and wherein at least one of said peripheral pedestal mounts is secured to said said bit body via socket head cap screws.

30. The drill bit as set forth in claim 29, wherein said cap screws comprise 0.635 inch diameter threaded cap screws.

31. The drill bit as set forth in claim 1, wherein said bit body further comprises at least one longitudinally extending outwardly protruding bit shoulder.

32. The drill bit as set forth in claim 31, wherein said at least one longitudinally extending outwardly protruding bit shoulder comprises a radial distal radiused surface, and wherein said radiused surface is of complementary dimension to said pre-selected well bore diameter.

33. The drill bit as set forth in claim 1, wherein at least one of said pedestal mounts comprises a radial distal radiused surface, and wherein said radiused surface is of complementary dimension to said pre-selected well bore diameter.

34. A kit for replacement of wear parts in a drill bit of the type employing single cutting edge rolling disc type cutters, said kit comprising:

a cutter ring assembly, said cutter ring assembly further comprising (i) an annular cutter ring having an interior annulus defining portion and an outer ring portion, said outer ring portion including a cutting edge having an outside diameter and radius $R_1$ (ii) a bearing assembly, said bearing assembly adapted to substantially fit into said annulus of said cutter ring, and to be entirely laterally removable from a single side of said cutter ring, wherein said bearing assembly comprises a Journal bearing with spiral oil groove passageways therein, and (iii) a seal assembly.

35. A rolling disc cutter of the type which upon rolling forms a kerf by penetration into a face being drilled, so that, when two or more cutters are used, solid matter between a proximate pair of said kerfs is fractured to produce chips which separate from said face, and wherein said disc cutter comprises:

(a) a relatively stiff shaft, said shaft having a proximal end and a distal end, an axis for rotation thereabout, and a seal receiving portion;

(b) a cutter ring assembly, said cutter ring assembly further comprising (i) an annular cutter ring having an interior annulus defining portion and an outer ring portion, said outer ring portion including a cutting edge having an outside diameter and radius $R_1$ (ii) a bearing assembly, said bearing assembly adapted (A) to substantially fit into said annulus of said cutter ring, and (B) in a close fitting relationship with said shaft, so that said cutter ring may rotate with respect to and be supported by said shaft, (iii) said bearing assembly comprising (A) a bearing, and (B) a seal assembly, said seal assembly adapted to fit sealingly between said cutter ring and said seal receiving portion of said shaft, so as to form a lubricant retaining seal for said interior annulus portion of said cutter ring, (c) a retainer assembly, said retainer assembly adapted to retain said cutter ring assembly onto said shaft and to absorb at least a portion of axial loading on said disc cutter, (d) a cap, said cap having an interior surface portion, said cap adapted to seal said interior annular portion of said cutter ring assembly, and to interfittingly engage at least a portion of said retainer assembly, so that, in cooperation with said seal assembly and said cutter ring, a lubricant retaining chamber is provided, and wherein said cap absorbs at least a portion of axial load from said retainer assembly.

36. The disc cutter as set forth in claim 35, wherein said cap is retained to said cutter ring assembly by retaining wire.

37. A rotary drill bit comprising:

(a) a bit body, said bit body extending along a longitudinal axis, comprising (i) an upper end adapted for interconnection to a drilling string;

(ii) a plurality of angularly spaced apart longitudinally extending peripheral slots;

(b) a plurality of detachably affixable pedestal mounts, said pedestal mounts detachably affixable to said peripheral slots, each of said pedestal mounts further comprising (i) a shaft portion (ii) a true circular rolling disc cutter rotatably mounted on said shaft portion;

(iii) a bearing means between each rolling disc cutter and said shaft;

(iv) seal means between each rolling disc cutter and said shaft;

(c) said plurality of rolling disc cutters providing a bit cutting diameter of 17.5 inches or less.

38. The rotary drill bit as set forth in claim 37, wherein each slot further comprises a wedge shaped side portion, and wherein each pedestal mount comprises a complementary wedge shaped edge portion, and wherein said pedestal mount is detachably affixed in secure interfitting fashion in said longitudinal slot.

39. The rotary drill bit as set forth in claim wherein said bearing means further comprises (a) a journal bearing, said journal bearing affixed between said shaft and said rolling disc cutter, and (b) a retainer, said retainer detachably affixed to said shaft portion to secure said journal bearing in operating position.

40. The rotary drill bit as set forth in claim 39, wherein (a) said seal means further comprises an oil containing chamber, and (b) said retainer further comprises oil grooves, said oil grooves adapted to allow oil to flow from said oil containing chamber to said bearing means.

41. The rotary drill bit as set forth in claim 39, wherein (a) said seal means further comprises an oil containing chamber, and (b) said journal bearing further comprises oil grooves, said oil grooves adapted to allow oil to flow from said oil containing chamber to lubricate said journal bearing.

42. The rotary drill bit as set forth in claim 41, wherein said oil grooves are disposed in a peripheral spiral pattern on said journal bearing.

43. The rotary drill bit as set forth in claim 37, wherein (a) said plurality of rolling disc cutters are mounted in a preselected radially spaced apart fashion, and (b) an outermost of said rolling disc cutters defines the cutting diameter of said drill bit.

44. The rotary drill bit as set forth in claim 43, wherein said plurality of rolling disc cutters comprises at least 5 rolling disc cutters.

45. The rotary drill bit as set forth in claim 43, wherein said plurality of rolling disc cutters comprises at least 7 rolling disc cutters.

46. A drill bit for use in drilling a well bore of preselected diameter, said bit comprising:

(a) a bit body, said bit body adapted to be rotated about a longitudinal axis of rotation, said bit body further comprising a bottom, and a plurality of peripheral longitudinal slots, said longitudinal slots located at pre-selected angularly spaced apart locations, said longitudinal slots comprising (i) an upper ledge, (ii) a bottom wall, said bottom wall extending longitudinally to said bottom of said bit body, (iii) a first inward sidewall, (iv) a second inward sidewall;

an upper ledge and downwardly extending sidewalls;

(b) a set of peripheral pedestal mounts, each of said peripheral pedestal mounts comprising (i) a first sidewall adapted to mate with said first inward sidewall of said longitudinal slot, (ii) a second sidewall adapted to mate with said second inward sidewall of said longitudinal slot so as to secure said pedestal mount in said bit body, and (iii) a radially inward side, said radially inward side adapted to fit into said longitudinal slots in a close, securely interfitting fashion with said bottom wall of said longitudinal slot;

(c) each of said peripheral pedestal mounts further comprising a small diameter single cutting edge true circular rolling disc cutter, said rolling disc cutter affixed to said peripheral pedestal mount at a pre-selected radial location on said bit body, and mounted at a preselected angle delta with respect to said longitudinal axis, and wherein said true circular rolling disc cutter forms a circular kerf by penetration into a face being drilled, to fracture solid matter between a proximate pair of said kerfs to produce chips which separate from said face, and (c) where said rolling disc cutters provide said drill bit with a cutting diameter of 17½ inches (44.45 cm) or less.

47. The drill bit as set forth in claim 46, wherein each of said rolling disc cutters comprises a member of a series of cutters in the set 2, 3, . . . n−2, n−1, n, wherein n is a positive integer.

48. The drill bit as set forth in claim 47, wherein n is 5, 6, or 7.

49. The drill bit as set forth in claim 46, wherein in said peripheral pedestal mounts are detachably affixed to said bit body.

* * * * *

UNITED STATES PATENT AND TRADEMARK OFFICE

CERTIFICATE OF CORRECTION

PATENT NO. : 6,131,676 
DATED : October 17, 2000
INVENTOR(S) : Friant, James E. and Anderson, Michael A.

It is certified that error appears in the above-identified patent and that said Letters Patent is hereby corrected as shown below:

Title page, Item [54] and Column 1, line 1,
Title, after the word "DISC", delete the word "CUTTER" and substitute therefore -- CUTTERS --.
Item [56], References Cited,
Under FOREIGN PATENT DOCUMENTS, after the reference "1305295 4/1987 Russian Federation.", delete "146157" and substitute therefore -- 1467157 --.
Under U.S. PATENT DOCUMENTS, after the reference "4,832,136 5/1989 Mattsson et al… 175/57", delete "4,848,497" and substitute therefore -- 4,848,491 --.

Column 6,
Line 46, after the word "valleys" delete "between".

Column 8,
Line 44, after the word "through", delete "$^{34}$n" and substitute therefore -- $34_n$ --.
Line 54, after the word "pedestal," delete "341" and substitute therefore -- $34_1$ --.
Line 57, after the word "through", delete "$^{34}$n" and substitute therefore -- $34_n$ --.

Column 9,
Line 12, after the word "pedestals", delete "$^{34}$1 through $^{34}$n" and substitute therefore -- $34_1$ through $34_n$ --.

Column 11,
Line 65, after the words "surface 246" delete "axialy" and substitute therefore -- axially --.

Column 16,
Line 6, delete "axialy" and substitute therefore -- axially --.
Line 40, after the words "secured to", delete "said".

UNITED STATES PATENT AND TRADEMARK OFFICE

CERTIFICATE OF CORRECTION

PATENT NO. : 6,131,676 
DATED : October 17, 2000
INVENTOR(S) : Friant, James E. and Anderson, Michael A.

It is certified that error appears in the above-identified patent and that said Letters Patent is hereby corrected as shown below:

Column 18,
Line 5, after the words "drill bit as set forth in", delete the word "claim" and substitute therefore -- claim 37 --.

Signed and Sealed this

Thirteenth Day of August, 2002

*Attest:*

*Attesting Officer*

JAMES E. ROGAN
*Director of the United States Patent and Trademark Office*